US007356968B2

(12) United States Patent
Joyce et al.

(10) Patent No.: US 7,356,968 B2
(45) Date of Patent: Apr. 15, 2008

(54) POLYMER COMPOSITE BASEMENT DOOR

(75) Inventors: Roger F Joyce, Guilford, CT (US); Lawrence R Jones, Conifer, CO (US)

(73) Assignee: The Bilco Company, West Haven, CT (US)

( * ) Notice: Subject to any disclaimer, the term of this patent is extended or adjusted under 35 U.S.C. 154(b) by 605 days.

(21) Appl. No.: 10/743,890

(22) Filed: Dec. 22, 2003

(65) Prior Publication Data

US 2005/0144872 A1 Jul. 7, 2005

(51) Int. Cl.

| | |
|---|---|
| ***E04B 7/16*** | (2006.01) |
| ***E04F 17/06*** | (2006.01) |
| ***E05D 15/48*** | (2006.01) |
| ***E05D 15/00*** | (2006.01) |

(52) U.S. Cl. ..... 52/19; 52/107; 49/169; 49/381

(58) Field of Classification Search ..... 52/169.9, 52/107, 19, 20, 79.1, 79.5, 79.6, 208; 49/402, 49/367, 386, 504, 380, 381, 397, 169, 387
See application file for complete search history.

(56) References Cited

U.S. PATENT DOCUMENTS

| | | | | | |
|---|---|---|---|---|---|
| 879,200 | A * | 2/1908 | Schrader | 49/367 |
| 2,174,989 | A * | 10/1939 | Lyons | 49/367 |
| 3,067,453 | A | 12/1962 | Lyons | |
| 3,103,996 | A * | 9/1963 | Wyatt, Jr. | 49/367 |
| 3,340,649 | A * | 9/1967 | Erlandsen | 49/367 |
| 4,104,761 | A | 8/1978 | Lyons | |
| 4,493,118 | A * | 1/1985 | Braxton | 4/460 |
| 4,775,570 | A * | 10/1988 | Ohlenforst et al. | 428/83 |
| 4,873,791 | A * | 10/1989 | Lyons, Sr. | 49/386 |
| 5,040,269 | A | 8/1991 | Lyons, Jr. | |
| 5,093,941 | A * | 3/1992 | Muller | 4/479 |
| 5,428,925 | A * | 7/1995 | Snyder | 49/367 |
| 5,600,921 | A * | 2/1997 | Vardaro | 49/380 |
| 5,749,182 | A * | 5/1998 | Vavrinak | 52/169.14 |
| 5,769,260 | A | 6/1998 | Killinger et al. | |
| 6,321,491 | B1 * | 11/2001 | DiMauro | 52/20 |
| 6,408,796 | B1 | 6/2002 | Hampel | |
| 6,418,672 | B1 | 7/2002 | Hampel | |
| 6,446,414 | B1 | 9/2002 | Bullard, III et al. | |
| 6,668,487 | B2 * | 12/2003 | Vesey | 49/169 |
| 6,799,395 | B1 * | 10/2004 | Dabrowski et al. | 49/386 |
| 6,941,709 | B1 * | 9/2005 | Stanford, Sr. | 52/169.6 |
| 2003/0074841 | A1 * | 4/2003 | Vesey | 49/169 |
| 2003/0097802 | A1 | 5/2003 | Kim et al. | |
| 2003/0150569 | A1 * | 8/2003 | Pylkki et al. | 160/371 |
| 2005/0016072 | A1 * | 1/2005 | Dabrowski et al. | 49/387 |

* cited by examiner

*Primary Examiner*—Robert Canfield
*Assistant Examiner*—Ryan D Kwiecinski
(74) *Attorney, Agent, or Firm*—DeLio & Peterson, LLC

(57) ABSTRACT

Cellar or bulk head doors having sidewalls are provided which are made of a polymer and which are strong, durable, attractive, virtually maintenance free, easily assembled, have connection and anchorage points which allow the door assembly to be used over a wide temperature range without damage to the polymer parts making up the assembly and which has an opening preferably in one or both of the sidewalls for inserts such as a window, louver, screen or blank and which insert may be easily changed without tools for the purpose of providing light, ventilation, or security. The doors also may be extended from the structure being enclosed using opposed vertical extenders mated with a horizontal extender.

19 Claims, 21 Drawing Sheets

POLYMER COMPOSITE BASEMENT DOOR

BACKGROUND OF THE INVENTION

1. Field of the Invention

The present invention relates to horizontal hinged door assemblies such as cellar or bulk head doors having sidewalls and, in particular, to such door assemblies made of a polymer which are strong, durable, attractive, virtually maintenance free, easily assembled, have connection and anchorage points which allow the door assembly to be used over a wide temperature range without damage to the polymer parts making up the assembly and which has an opening preferably in one or both of the sidewalls for inserts such as a window, louver, screen or blank and which insert may be easily changed for the purpose of providing light, ventilation, or security.

2. Description of Related Art

Cellars doors are very well known and provide access directly from the basement to the outdoors for homes and other buildings. Cellar doors are very useful because they open the basement to a number of opportunities including a basement exit in case of emergency, worker access to mechanical equipment without entering the main level of the building, and the ability to move large furniture and equipment, bulky appliances and patio furniture easily to and from the basement.

Typically, the cellar door is made of metal and a number of cellar doors are shown in U.S. Pat. Nos. 3,067,453; 4,104,761; 4,873,791; 5,040,269; and 5,600,921. A fiberglass bulk head door assembly is shown in U.S. Pat. No. 5,428,925. All the above patents are hereby incorporated by reference.

As discussed in U.S. Pat. No. 5,428,925, supra, the prior art cellar doors fabricated from wood or steel have certain disadvantages such as rotting or rusting which is also accelerated when the door is in a shaded or damp location. The deterioration of the door causes several problems including water leakage and the door becoming unsightly and, eventually, the building owner must replace the cellar door assembly at a considerable expense.

Another problem of cellar doors is that they do not provide exposure to the outdoors which exposure is desirable for enabling a person in the opening covered by the door to see out the door and for providing light and ventilation to the basement.

While polymer (plastic) cellar doors are desirable because they are resistant to deterioration, they pose the problem that exposure to the elements may damage the relatively fragile polymer door. Also, expansion and contraction of the polymer during changes in temperature may cause cracking of polymer components of the door especially at anchor and assembly points.

SUMMARY OF THE INVENTION

Bearing in mind the problems and deficiencies of the prior art, it is therefore an object of the present invention to provide a cellar door assembly which is made of a polymer and which door assembly is strong, durable, attractive and virtually maintenance free.

It is another object of the present invention to provide a cellar door assembly which has openings in the sidewalls and/or door leafs or other assembly components so that various inserts may be easily inserted in the openings and changed for the purpose of providing light, ventilation and/or security and which inserts may preferably be changed without the use of tools.

A further object of the present invention is to provide a cellar door assembly made of a polymer which door assembly allows for expansion and contraction of the parts of the polymer door assembly during temperature changes without damage to the polymer door assembly.

It is yet another object of the present invention to provide a cellar door assembly which is easy to assemble with the individual parts of the door shaped to fit with other joining parts and which parts may be easily secured together with screws or other fasteners.

Another object of the present invention is to provide a cellar door assembly which requires either no or minimal caulking or other gasketing and still provides a water-proof door assembly.

A further object of the present invention is that the door assembly can be made to simulate a wood appearance including a wood slat appearance for the door leafs.

Another object of the present invention is to provide a door assembly which is made of a polymer and which is lighter than conventional doors made of metal, wood or other such material.

Still other objects and advantages of the invention will in part be obvious and will in part be apparent from the specification.

The above and other objects and advantages, which will be apparent to those skilled in art, are achieved in the present invention which is directed to, in a first aspect, a polymer composite basement door comprising:

- a polymer composite frame positioned on a foundation surrounding an opening adjacent a building structure, the frame having opposed triangular sidewalls having a base, vertical leg, upper sloping surface, end and inner and outer walls and a header plate connecting each sidewall, with the header plate and vertical leg adjacent the building structure;
- one or more polymer composite door leafs hinged to the sidewalls for movement between an elevated open position providing access to the opening and a closed position covering the opening;
- one or more through openings in one or both of the sidewalls and/or door leafs or other door assembly components; and
- one or more inserts in the through opening.

In another aspect of the invention the inserts for the through openings in the sidewalls and door leafs may be a window, screen, louver, security panel, combinations thereof and the like.

In another aspect of the invention the triangular sidewalls, header plate and/or door leafs and other components of the door assembly are hollow and are made from a molding process such as blow molding.

In a further aspect of the invention the triangular sidewalls, door leafs and/or header plate have indents (core-outs) forming support ribs for increasing their strength and providing tool access to enhance ease of assembly.

In another aspect of the invention the base of the triangular sidewalls have a plurality of accessible through openings for fastening the base of the sidewall to the foundation using a fastener. It is preferred that the through openings are slots with the longitudinal axis of the slot running along the longitudinal axis of the sidewall. It is most preferred to decrease the length of the slot toward the leg of the sidewall so that the slots along the sidewall have a varying length depending on their location. The sidewalls may also have a slotted inwardly or outwardly extending flange which may be used to secure the base of the sidewall to the foundation.

In another aspect of the invention the leg of the triangular sidewalls has two or more vertically spaced accessible through openings for fastening the leg of the sidewall to the building structure and/or a vertical extension header as will be described further below. The upper through openings are preferably slotted and the longitudinal axis of the upper slot is at an angle to the vertical plane of the sidewall leg.

In a further aspect of the invention the header plate has a straight rear edge for positioning against the building structure and a front edge which is a U-shape having a left arm and a right arm which lower portion of the arms mate with the upper surface of the corresponding sidewalls to form the door assembly frame. The U-shape front edge of the header plate preferably has an upwardly extending lip so that water falling on the header plate is diverted around the lip toward the mated sidewall and away from the opening.

In another aspect of the invention the sidewalls have a raised edge running along the inner edge of the upper surface of the sidewall, which edge extends past the end of the mated arm of the header plate and the upper surface of the sidewall preventing water from seeping through the mated joint and entering the opening with the water instead seeping through the mated joint and flowing away from the opening to the outside surface of the sidewall by gravity.

In another aspect of the invention one or more vertical extension headers may be connected to the leg of the sidewall to extend the door assembly outward from the wall of the building structure with a mating horizontal extension header.

In another aspect of the invention the mating horizontal extension headers have a front end with an overhanging inverted J-shape and a rear end with a corresponding protruding J-shape so that the front end of one extension header and rear end of another extension header can be mated to form a waterproof joint if two extension headers are used to extend the door assembly from the building structure wall. The overhang of the front end of the horizontal extension header is configured to overhang a portion of the header plate to minimize water seepage into the door assembly.

In a further aspect of the invention, mated horizontal extension headers are waterproof in that water leaking into the mated J-joint flows to the end of the header and away from the opening by gravity.

In another aspect of the invention an elongated sill is provided for transverse placement at the end of the triangular sidewalls opposite the leg with the vertical sidewalls having a longitudinal indent near the end to accommodate the ends of the sill. The sill has elongated slots running along the longitudinal axis of the sill for securing the sill to the foundation and to allow for expansion and contraction of the sill during temperature changes. The sill is also preferably sized to provide a space between the ends of the sill and the sidewall housing to allow for expansion and contraction.

In another aspect of the invention the anchor and connection slots are configured to provide sufficient space between the ends of the slot and the fastener so that the ends of the component having the slot (e.g., sill, sidewall) will preferably not contact the fastener when the component is expanded or contracted due to temperature changes.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-10B of the drawings in which like numerals refer to like features of the invention.

Figure 1A:
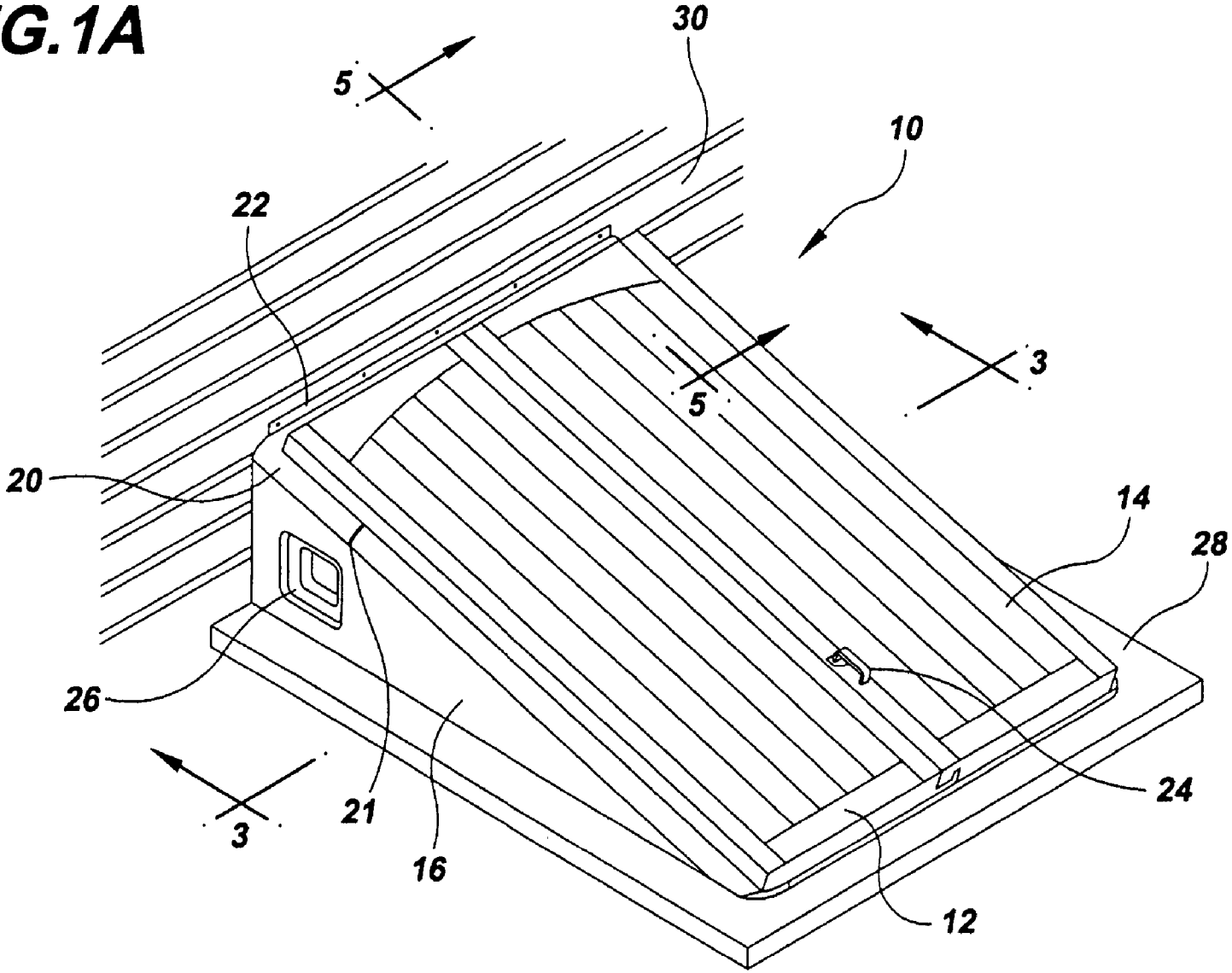
FIGS. 1A-1D show perspective views of a door assembly of the invention in the closed, partially open, and fully open positions.

Referring first to FIG. 1A, a door assembly of the invention is shown generally as 10. The door assembly 10 is shown in a closed position and is supported on a foundation 28 and secured to a structure 30. The door assembly 10 comprises a right door leaf 14 and a left door leaf 12 and a left sidewall 16 and right sidewall 18 (not shown). A handle 24 is shown in the right door leaf. A transverse header plate 20 is secured to the sidewalls adjacent the legs of the sidewalls and the rear edge of header 20 is also secured to the structure 30 by structure flange 22. A mated gap 21 is formed between the sidewall and header plate. A window 26 is shown in left sidewall 16.

Figure 1B:
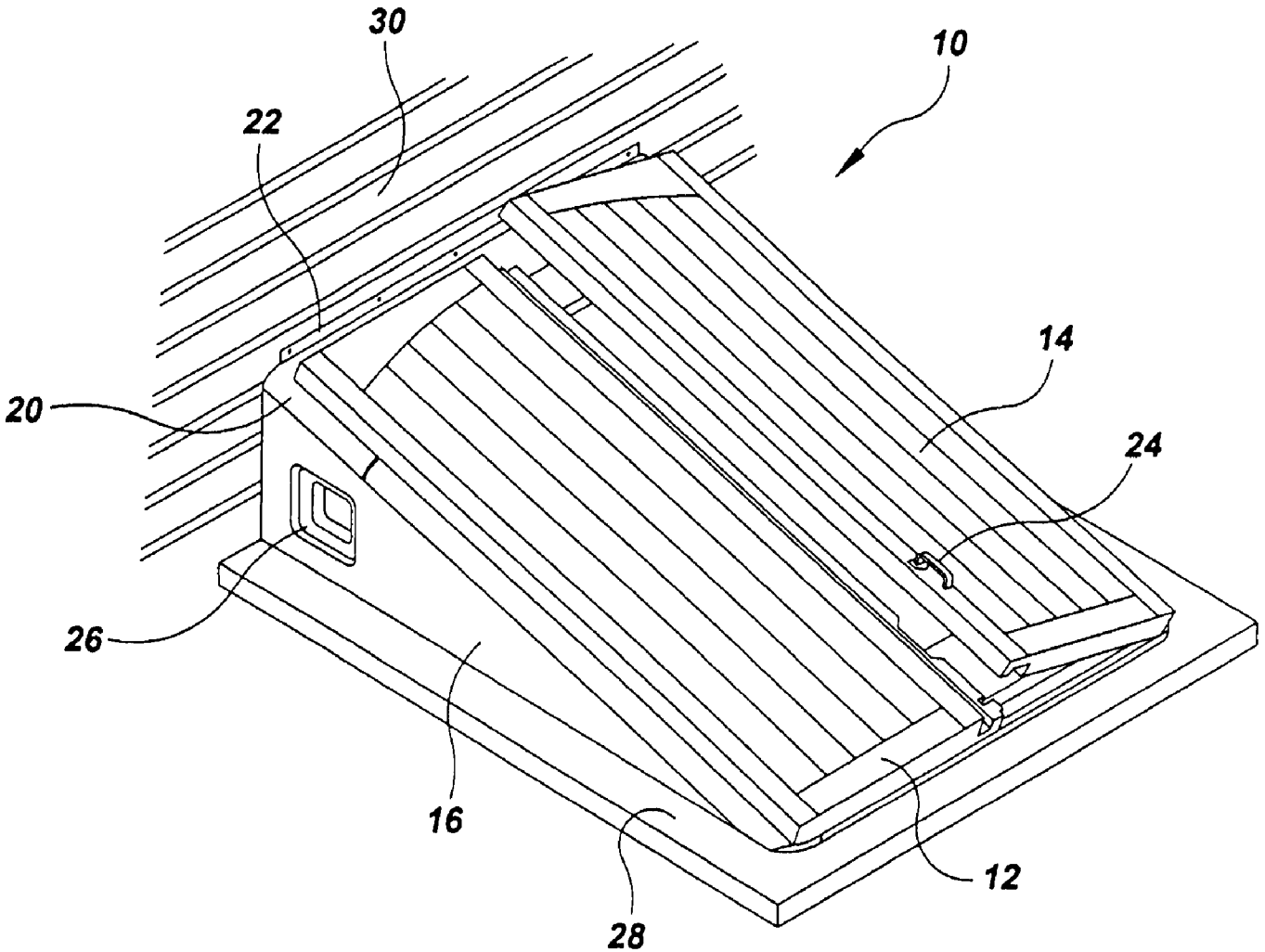

Referring now to FIG. 1B, the door assembly 10 is shown with the right door leaf 14 partially open.

Figure 1C:
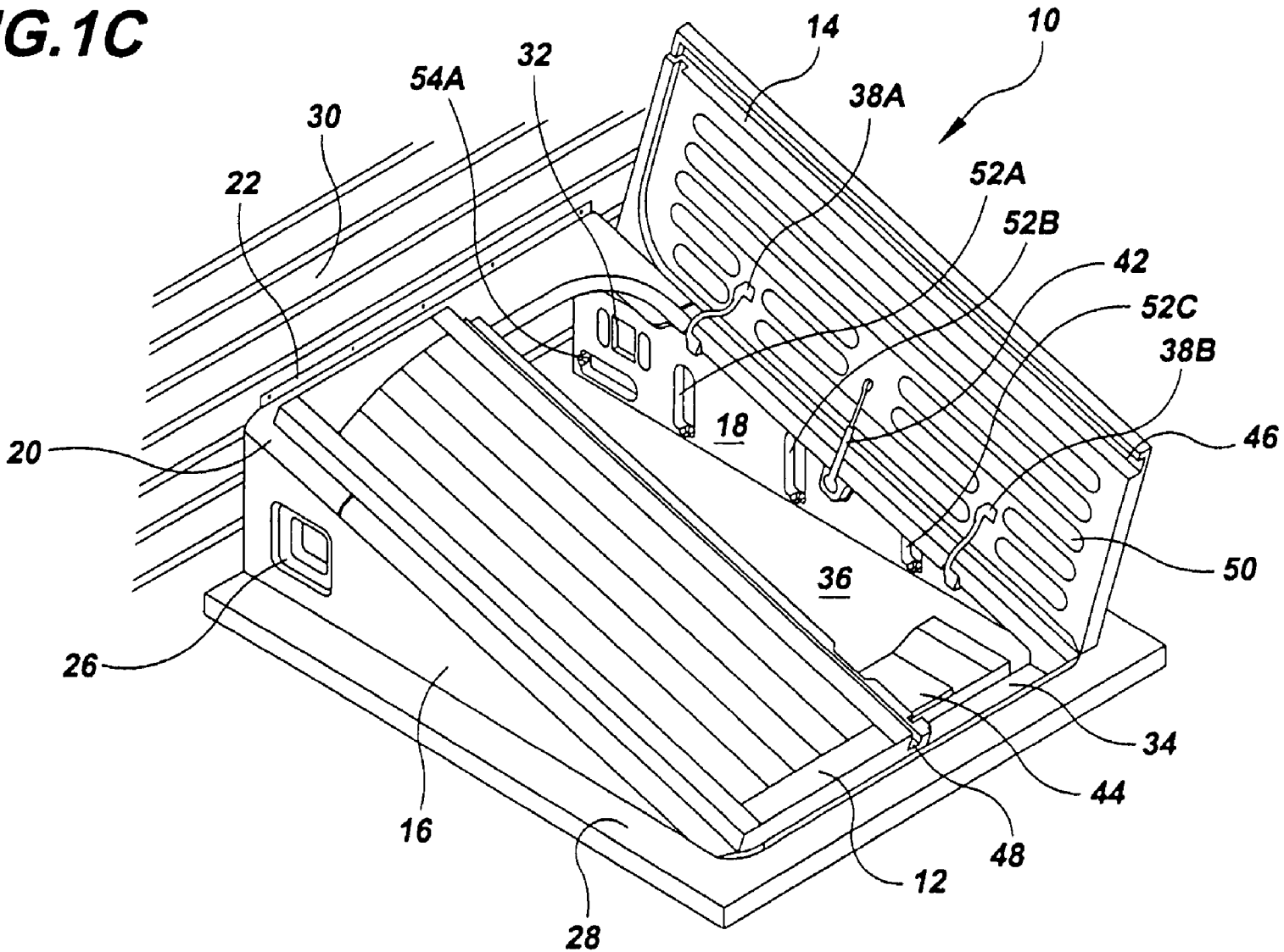

Referring to FIG. 1C, the door assembly 10 is shown with the right door leaf 14 in the fully open position. The door assembly 10 encloses opening 36 and descending stairs 44 are shown leading to a basement or other subsurface opening. Right door leaf 14 is shown having a lip 46 which when the door is closed mates with channel opening 48 in left door leaf 12. This enhances the waterproofness of the door assembly. A sill is shown as numeral 34.

Right sidewall 18 is shown having three vertical indents (also termed core-outs) 52A, 52B, and 52C. As will be shown further hereinbelow, the sidewalls 16 and 18 are blow molded and hollow with the indents providing structural support for the sidewalls as well as fastener openings so that the base of the sidewalls can be secured to the foundation 28. The indents also provide tool access to enhance ease of assembly of the door assembly. Horizontal indents 54A and 54B (not shown) have fastener openings for securing the leg of the sidewall to structure 30. A window 32 is also shown in the right sidewall.

Also shown in FIG. 1C are right door hinges 38A and 38B which are secured to the sidewall 18 and the door leaf 14. A gas piston for aiding opening and closing the door leaf is shown as numeral 42 and is secured to the sidewall 18 and door leaf 14. The door is blow molded and hollow and is shown having a plurality of elongated longitudinal indentations 50 which provide structural support to the door leaf.

Figure 1D:
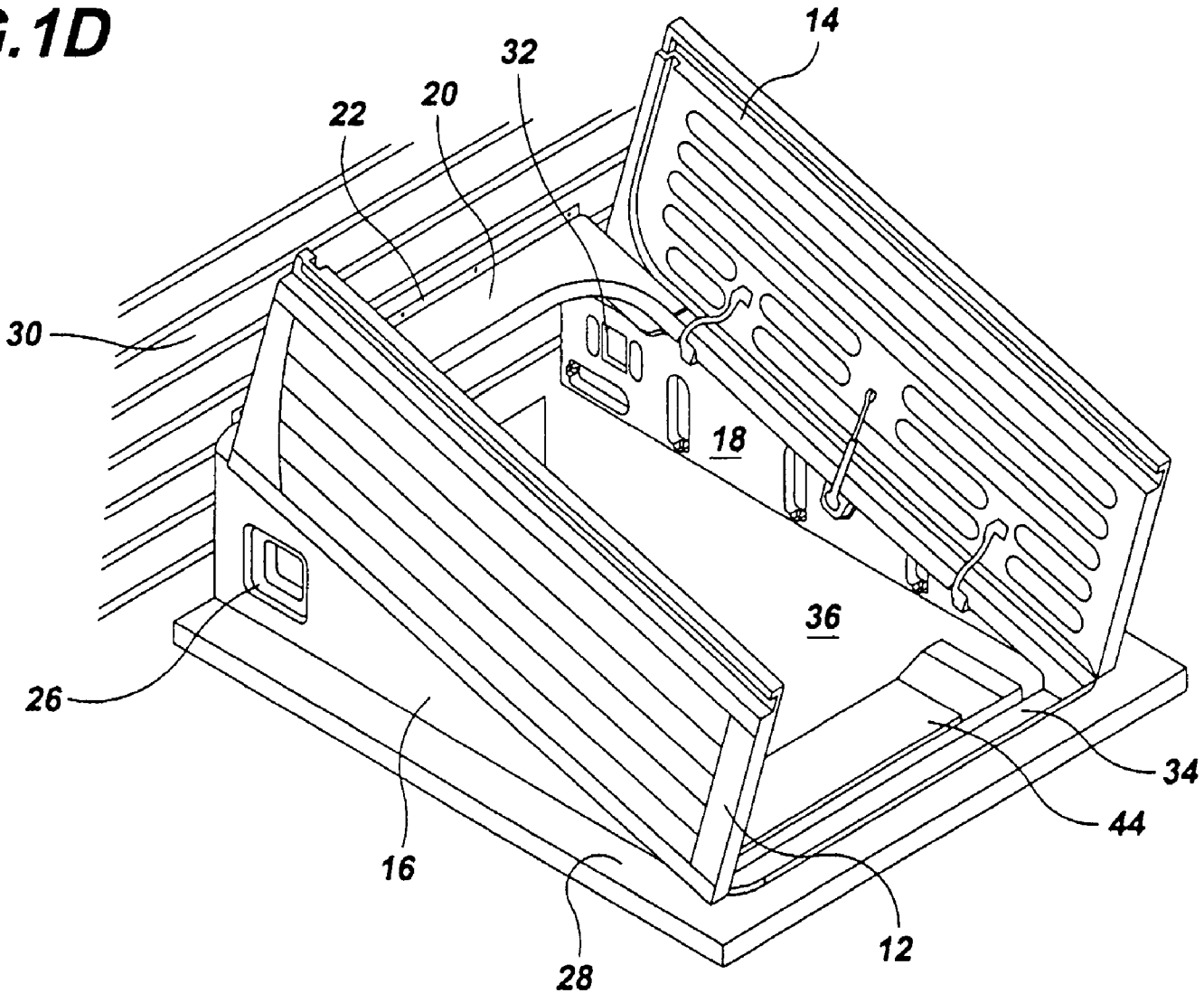

FIG. 1D shows the door assembly in the fully open position.

Figure 2:
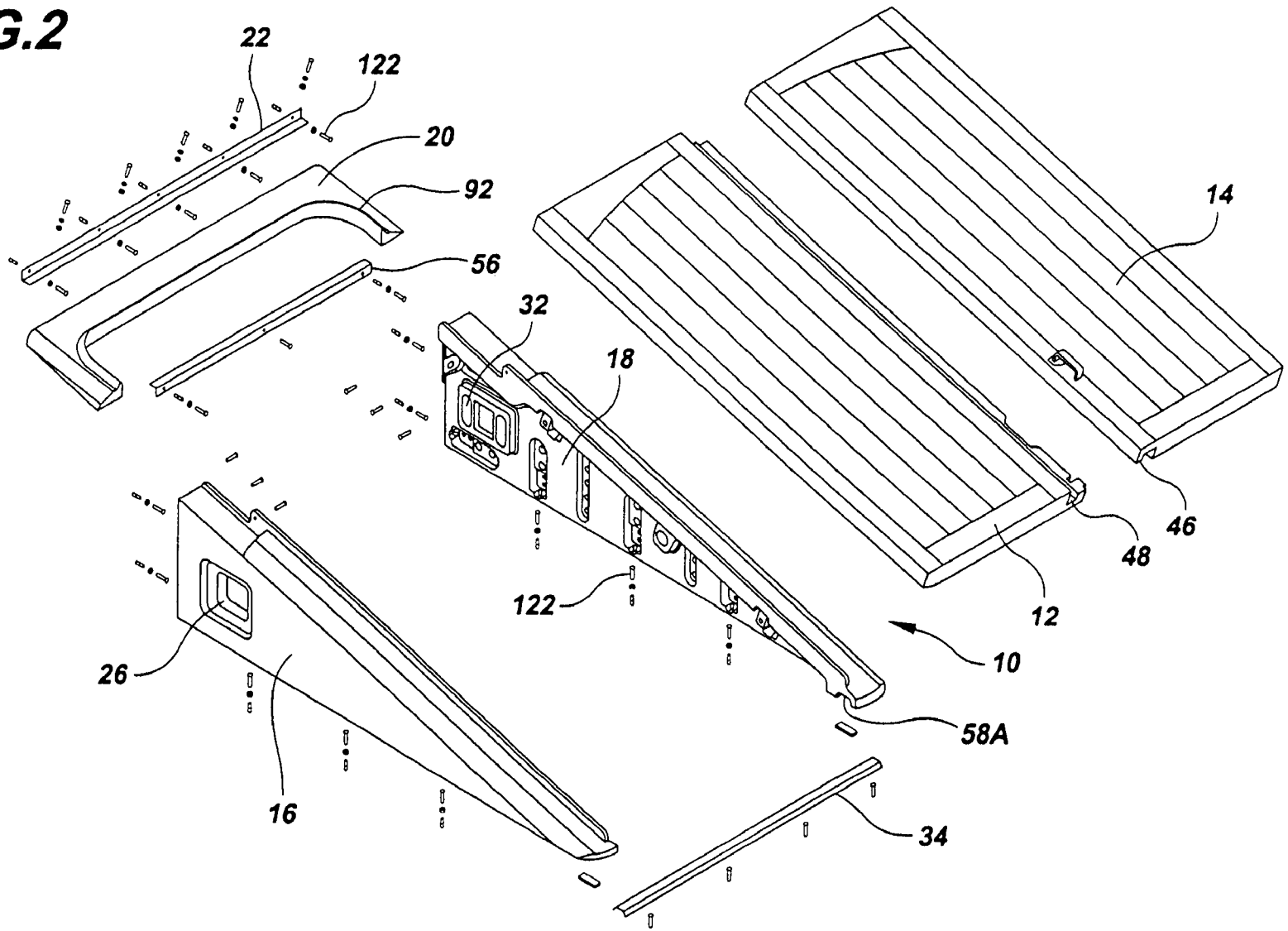
FIG. 2 is an exploded view of the door assembly shown in FIGS. 1A-1D.

FIG. 2 shows an exploded view of the door assembly 10 of FIG. 1A. Left door leaf 12 and right door leaf 14 would be secured respectively to left sidewall 16 and right sidewall 18 as described above. The elongated channel 48 in left door leaf 12 mates with lip 46 of right door leaf 14 to provide an enhanced waterproof fit. Right sidewall 18 is shown having an indentation 58A at its lower end which will accommodate sill 34. This will be described in further detail below. Right sidewall 18 is shown having a window opening 32 and left sidewall 16 is shown having a window opening 26. The base of header 20 will rest on and mate with the flat upper portions of left sidewall 16 and right sidewall 18 as discussed below. The structure flange 22 would be secured to the header 20 and to the structure as shown in FIG. 1A. A return flange 56 is secured to the header 20 to provide an additional lip to direct rain or other water from flowing into the opening secured by the door assembly. The header 20 as described hereinbelow has a raised lip 92 around the U-shaped opening which directs water toward the sides of the header and the return flange 56 provides additional protection against water overflowing the lip and entering the opening secured by the door assembly. Fasteners 122 are shown securing the door assembly components together as well as to the foundation and structure.

Figure 3:
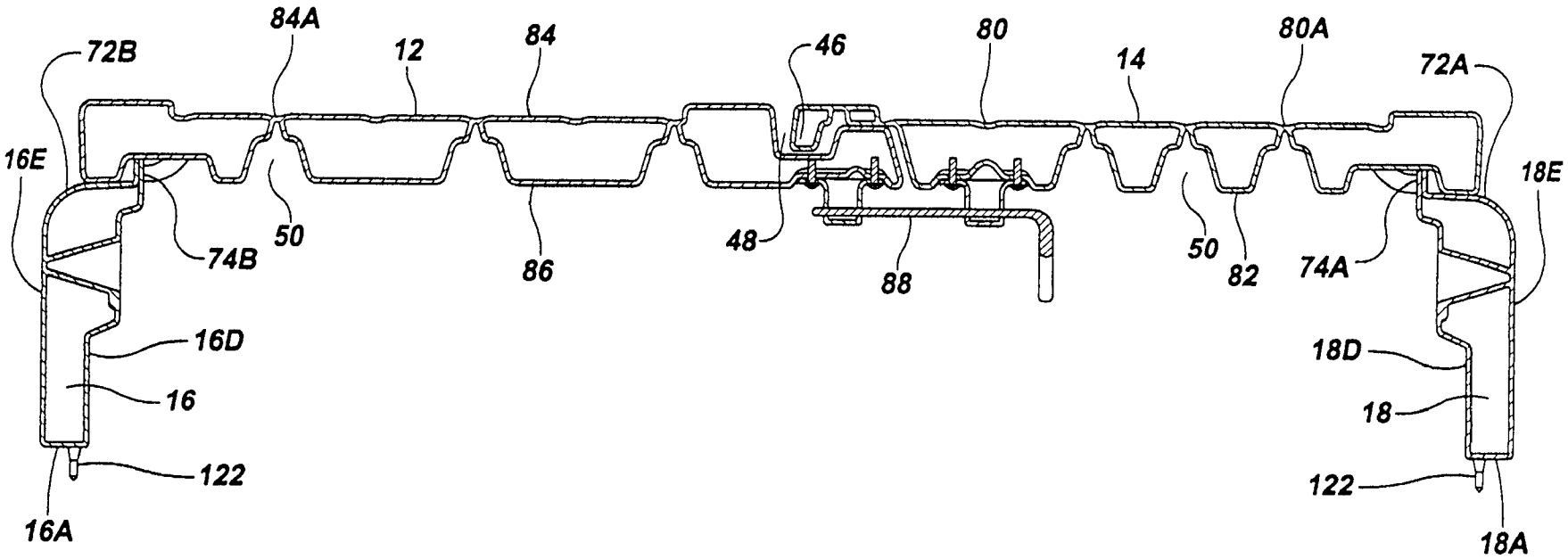
FIG. 3 is a cross-sectional view of the door assembly of FIG. 1A taken along lines 3-3.

FIG. 3 is a cross-sectional view of FIG. 1A showing left door leaf 12 and right door leaf 14 in the closed position. A conventional bar lock 88 is shown locking the door leafs together. Left door leaf 12 is shown supported by left sidewall 16 and right door leaf 14 is shown supported by right sidewall 18. Left sidewall 16 and right sidewall 18 have a lip or edge 74B and 74A, respectively, extending along the inner edge of the sidewall to provide protection against water entering the opening. The lips are extended past the juncture of the header and the sidewall to provide additional waterproofing protection as described below. The outer edge of each door leaf rests on the upper surfaces 72A and 72B of the sidewalls. The right door leaf 14 is shown having an upper surface 80 and a lower surface 82 with indents or channels 50 running along the longitudinal axis of the door. Likewise, left door leaf 12 is shown having an upper surface 84 and a lower surface 86 with channels 50 running along the door. The doors which are hollow are structurally strong because of the channels 50 running along the door. The channels 50 provide structural support for the door leafs. The upper surface of the door leafs have grooves 80A and 84A for decorative purposes. The upper surface and other surfaces of the door assembly may also be textured to simulate a wood grain appearance.

The sidewalls have a base 16A and 18A, inner walls 16D and 18D and outer walls 16E and 18E. Fasteners 122 are shown extending from the base.

Figure 4A:
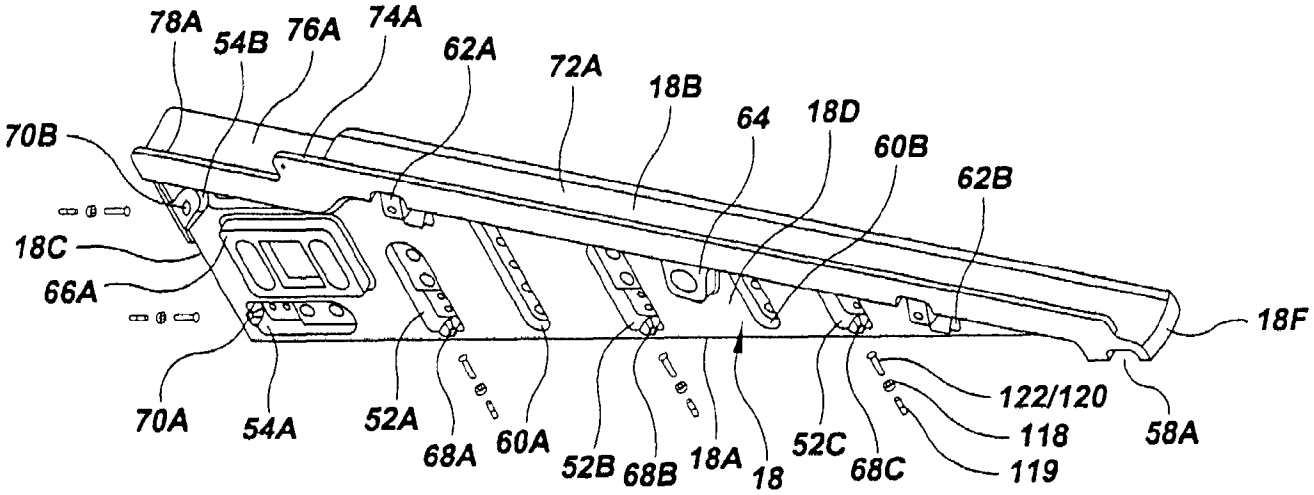
FIGS. 4A and 4B are perspective views of the right sidewall and left sidewall respectively of the door assembly shown in FIGS. 1A-1D and exploded view of FIG. 2.

FIG. 4A shows a perspective view of right sidewall 18. The sidewall 18 is shown as triangular having base 18A, leg 18C, upper sloped surface 18B, inner wall 18D and with the end 18F having an indent opening 58A to accommodate a sill. Along the length of the sidewall are vertical indent openings 60A and 60B which provide support to the hollow sidewall. Vertical indent openings 52A, 52B and 52C are spaced along the length of the sidewall and also provide structural support for the sidewall as well as accessible openings 68A, 68B and 68C for securing the base 18A of the sidewall to the foundation using a tool. Likewise, horizontal indent openings 54A and 54B provide structural support for the sidewall and also openings 70A and 70B for securing the leg 18C of the sidewall to the structure or an extender as described below. Fasteners 122 are shown with washers 120, spacers 118 and anchor 119.

An inwardly protruding window flange 66A is shown which will accommodate various inserts including a window as will be described below. Also shown are flanges 62A and 62B for securing hinges to the sidewall. A flange 64 is shown for securing one end of the piston to the sidewall.

Figure 10A:
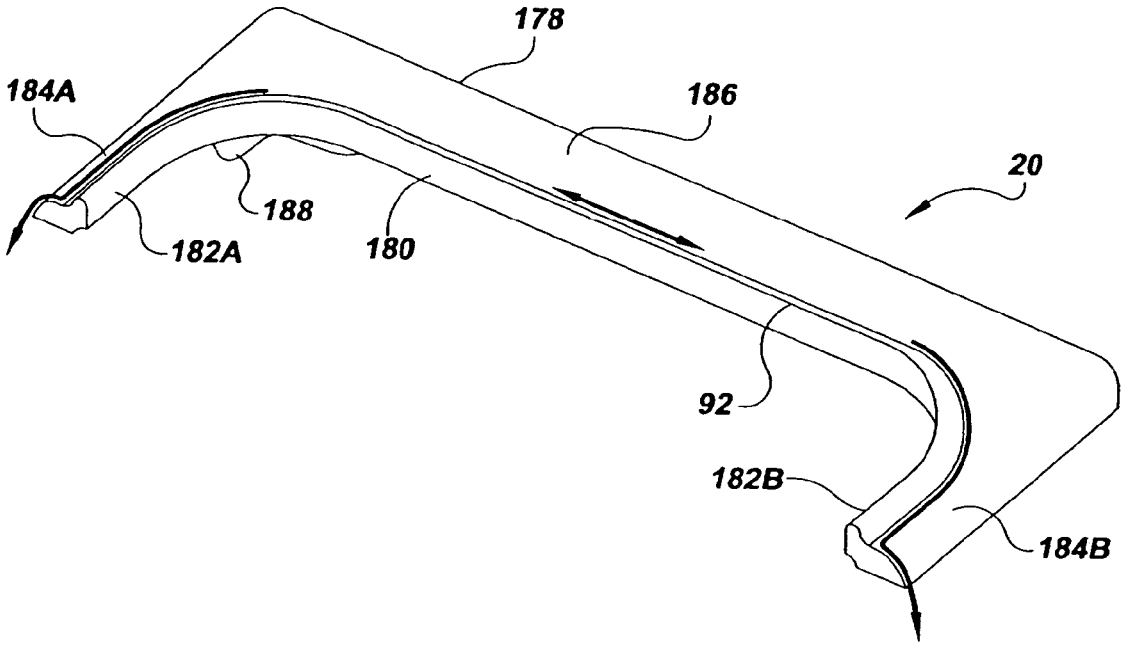
FIG. 10A is a perspective view of a header plate of the invention.

Sidewall 18 can be seen as having a curved upper surface 72A extending partly up the upper surface of the sidewall. Running along the curved surface 72A and extending past the curved surface is lip 74A. Lip 74A is then decreased in height for the remainder of the upper surface sidewall as shown by lip 78A. A portion of the sidewall upper surface has a flat surface 76A which accommodates the base of the header when the header is placed on the sidewall and secured to the sidewall. The header is secured to the sidewall through lip 74A and lip 78A. At the juncture 21 of the upper end of curved surface 72A and the end of header arm 184B (as shown in FIG. 10A), water leaking into the mated joint will flow away from the opening by gravity because of lip 74A and lip 78A.

Openings 68A, 68B and 68C in the base 18A of sidewall 18 are slotted to allow for expansion or contraction of the polymer during temperature change. It is highly preferred that the slots have a longitudinal axis running along the length of the sidewall and that the length of the slot increase toward the end 18F of the sidewall.

With regard to openings 70A and 70B for securing the leg of the sidewall to the structure, upper leg opening 70B is preferably slotted with the slot being angled to the vertical axis of the sidewall. Typically, a 45° angle is used. It has been found that providing the slots at an angle at the leg of the sidewall also prevents the polymer door assembly from cracking due to temperature changes. Opening 70A may be circular or slotted.

Figure 4B:
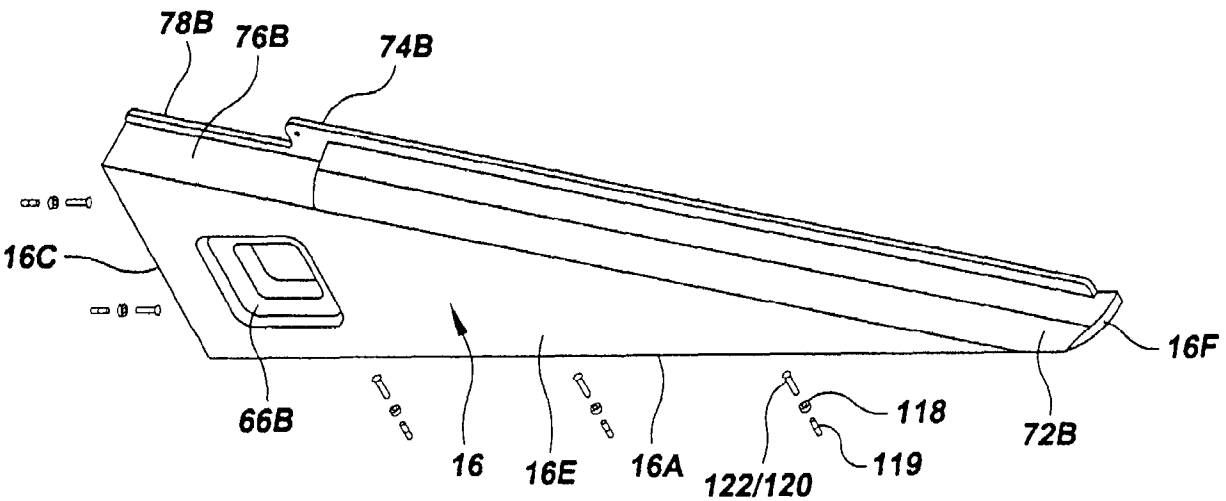

FIG. 4B is a perspective view of left sidewall 16 and can be seen to have curved upper surface 72B and lip 74B extending along the upper surface of the sidewall and past the curved portion 72B. A lower lip 78B extends to the end (leg) of the sidewall. Opening 66B is used for a window insert or other inserts. The sidewall has a flat upper surface 76B for mating with the header.

Figure 5:
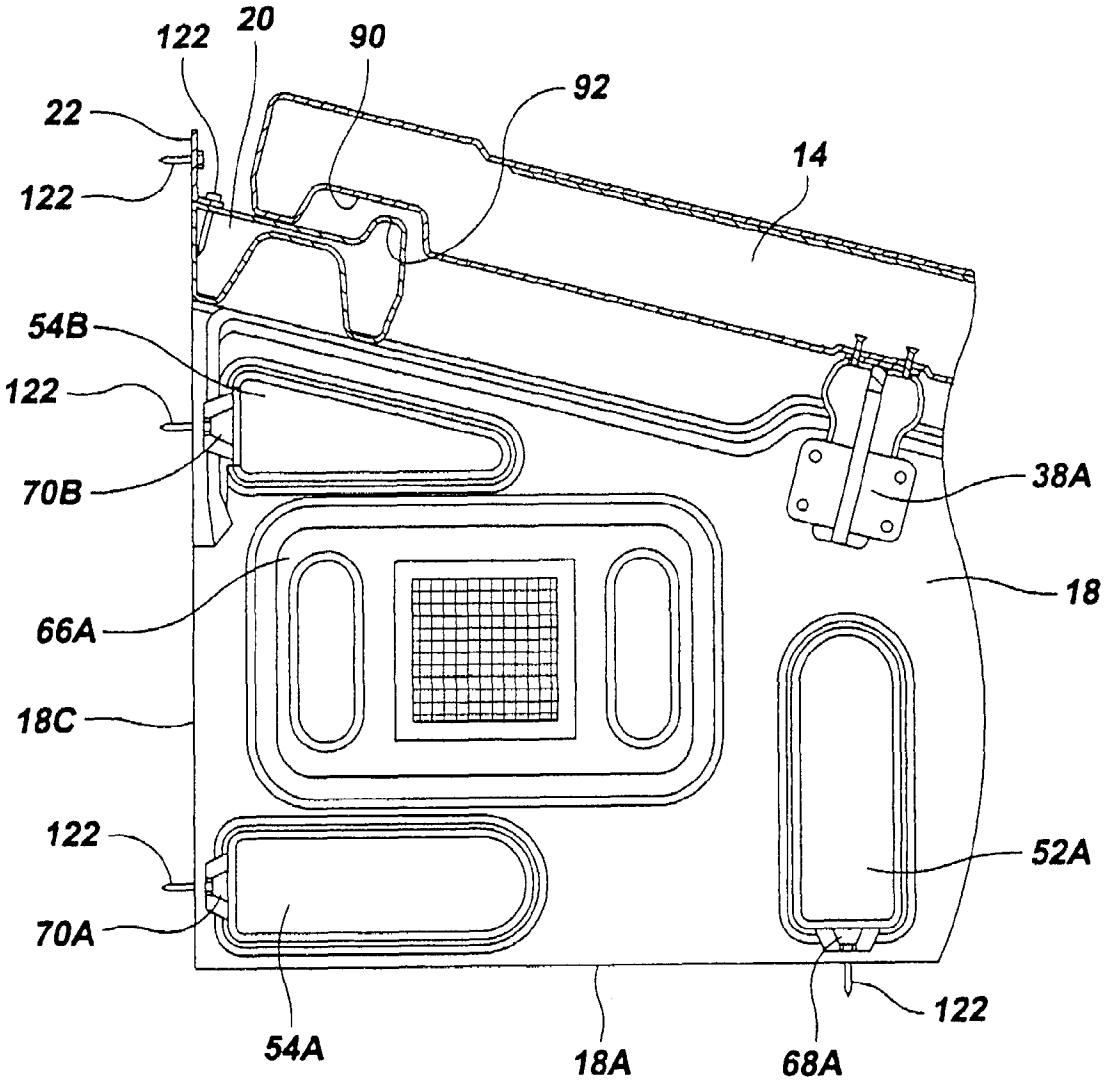
FIG. 5 is an enlarged cross-sectional view of the door assembly of FIG. 1A taken along lines 5-5.

Referring to FIG. 5, a sectional view of the leg end of right sidewall 18 is shown. The door leaf 14 is shown resting on header 20 and the door leaf is secured to the sidewall by hinge 38A. The header is shown as having a lip 92 which prevents water from entering the opening. The header is further secured to the door assembly and to the structure by structure flange 22 using fasteners 122 as shown. The upper part of the door leaf 14 has a channel 90 which mates with header lip 92. Horizontal openings 54A and 54B provide structural support to the sidewall as well as openings 70A and 70B for securing the leg 18C of the sidewall to the structure using fasteners 122. Likewise, vertical opening 52A provides structural support to the sidewall and an opening 68A to secure the base 18A of the sidewall to the foundation using a fastener 122. Flange 66A is used to hold the window and other inserts.

Figure 6:
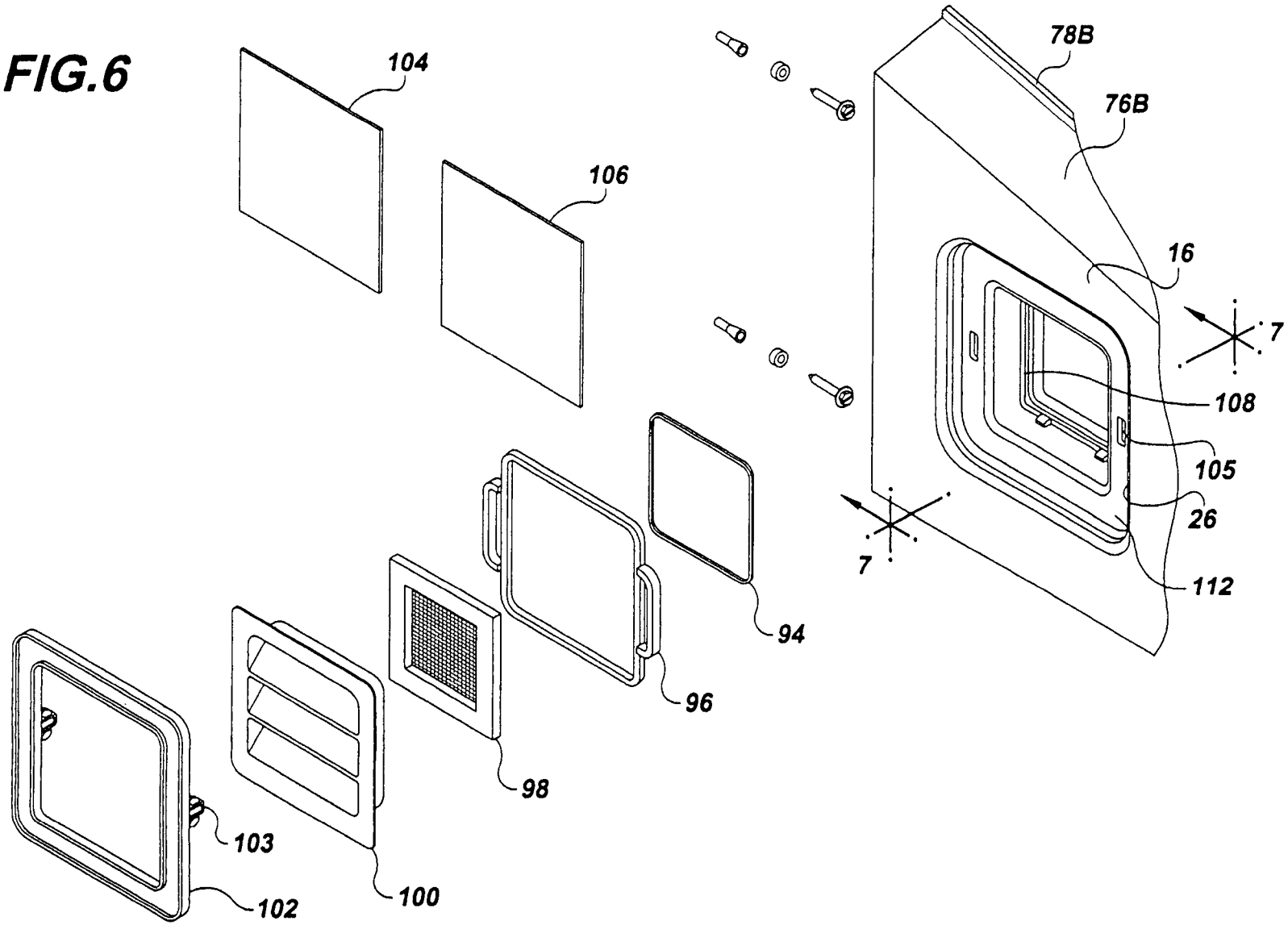
FIG. 6 is an exploded view of the left sidewall opening of FIG. 1A showing some of the various inserts which can be inserted into the opening.

Referring now to FIG. 6, a portion of left sidewall 16 is shown having sidewall window opening 26. The opening has an inner surface 108 and an outer surface 112. In use, a gasket 94 will be inserted into the opening against inner surface 108 followed by screen 98. In the embodiment shown, a snap sealing gasket 96 is then inserted against outer surface 112 followed by a louver panel 100. All the inserts are held in opening 26 by bezel 102 with the prongs 103 engaging openings 105. As will be appreciated by those skilled in the art, any combination of inserts could be used including a window panel 104 or a solid panel 106. Thus, by changing the inserts it is possible to provide a window opening, a screen opening, a screen and louver opening or to close the opening by inserting a solid panel into the opening. The inserts can preferably be changed without the use of tools.

Figure 7:
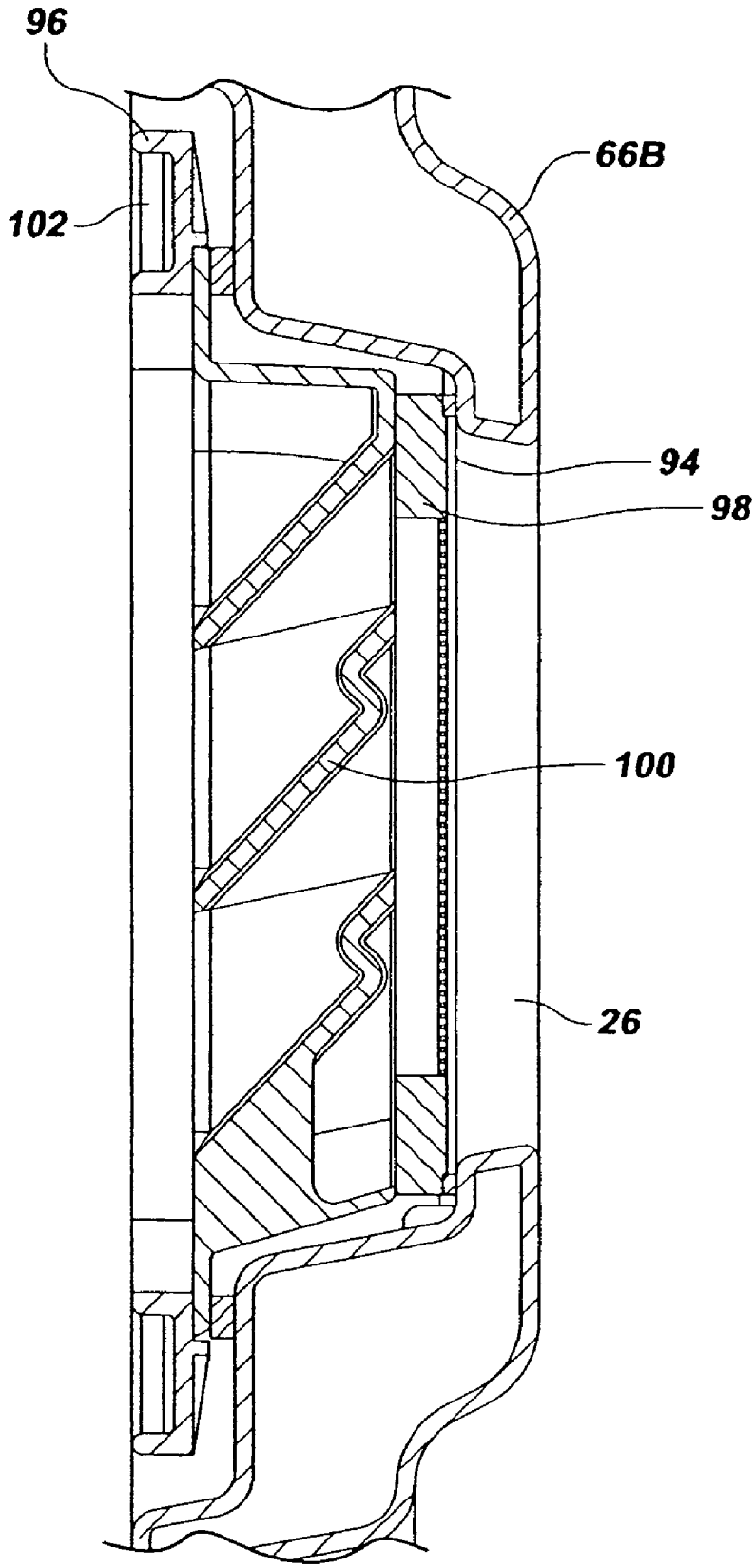
FIG. 7 is a cross-sectional view of FIG. 6 taken along line 6-6 and showing the inserts to be a snap sealing gasket, screen, louver and bezel.

FIG. 7 is a cross-sectional view of window opening 26 of FIG. 6. The window flange 66B has a window opening 26 and, in the embodiment shown, a bezel 102 holds in the opening, in sequence, a snap sealing gasket 96, a louver panel 100, and a screen 98. It will be appreciated by those skilled in the art any combination of inserts could be used to provide the desired "window" opening.

Figure 8:
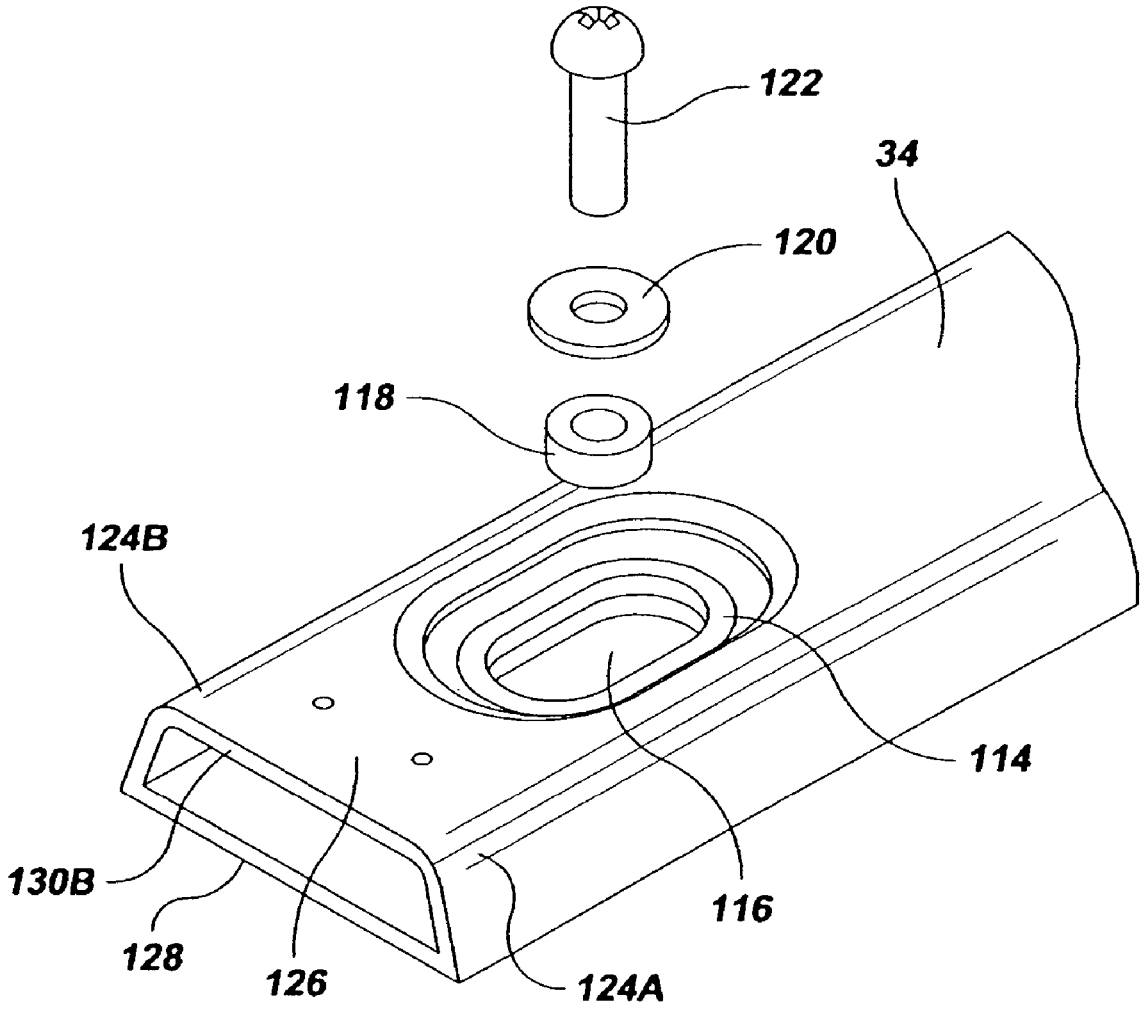
FIG. 8 is a perspective exploded view of a sill of the invention having an elongated slot for a fastener, spacer and washer.

Referring now to FIG. 8, a partial perspective view of sill 34 of the invention is shown. The sill can be an extruded metal such as aluminum or a polymer. The sill would have a plurality of slotted openings 114 running along the length of the sill. Each slotted opening has a through opening 116 to accommodate a spacer 118, washer 120 and fastener 122. The fastener 122 typically is held by an anchor 119 (not shown). The slot opening 116 is sized so that the sill can expand or contract without longitudinally compressing the spacer 118. The sill 34 is hollow and has an upper surface 126 and a lower surface 128 with rounded upper edges 124A and 124B. The end of the sill is shown as numeral 130B and the other end of the sill (not shown) would be numeral 130A.

Figure 8A:
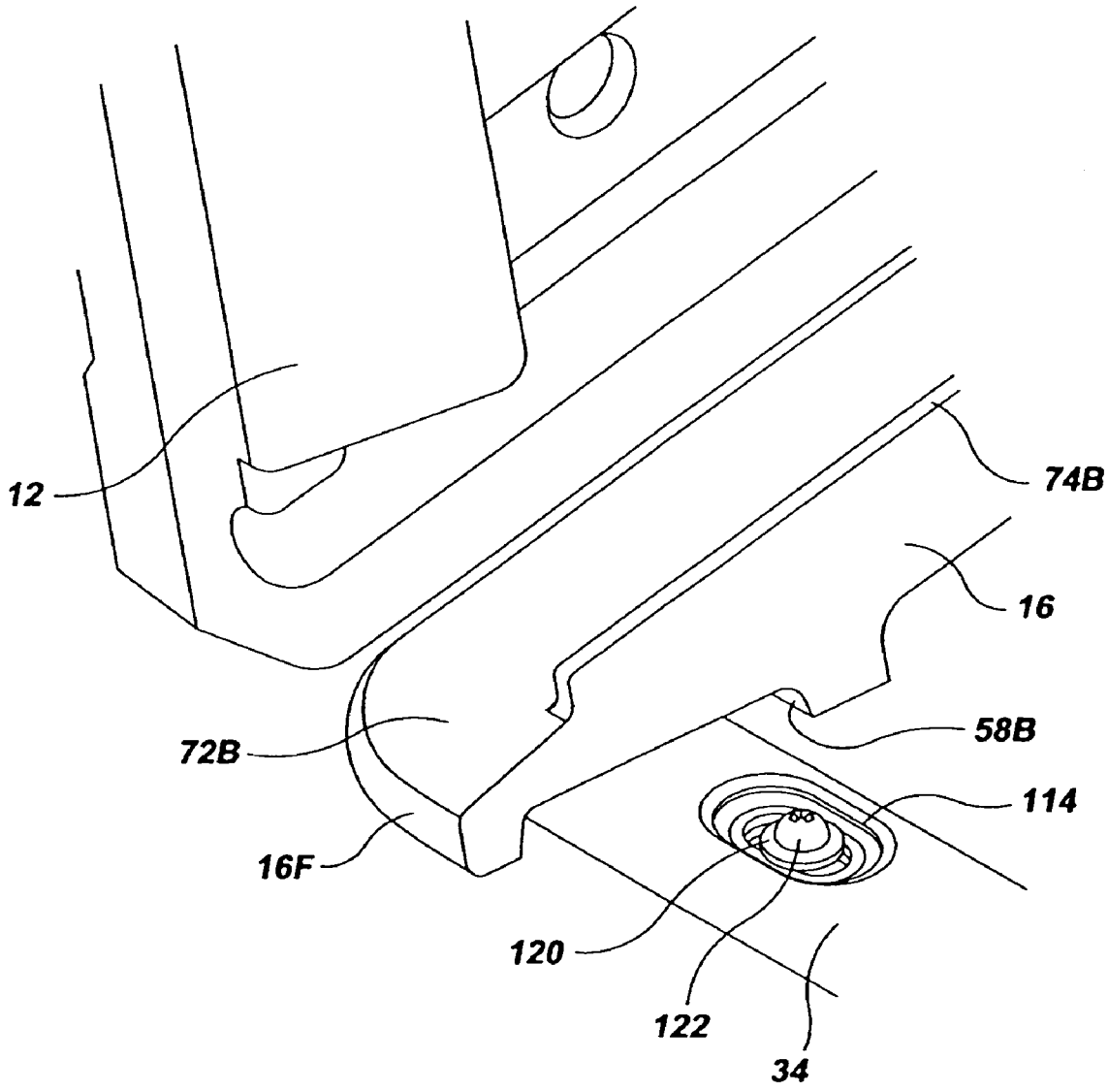
FIG. 8A shows the sill of FIG. 8 positioned under the end of the left sidewall.

FIG. 8A shows the sill 34 positioned in indent 58B at the end 16F of left sidewall 16. The door leaf 12 is shown in the opened position. As can be seen the end of sill 34 extends into indent opening 58B and is fastened to the foundation by fastener 122 with washer 120 in through slot 114.

Figure 8B:
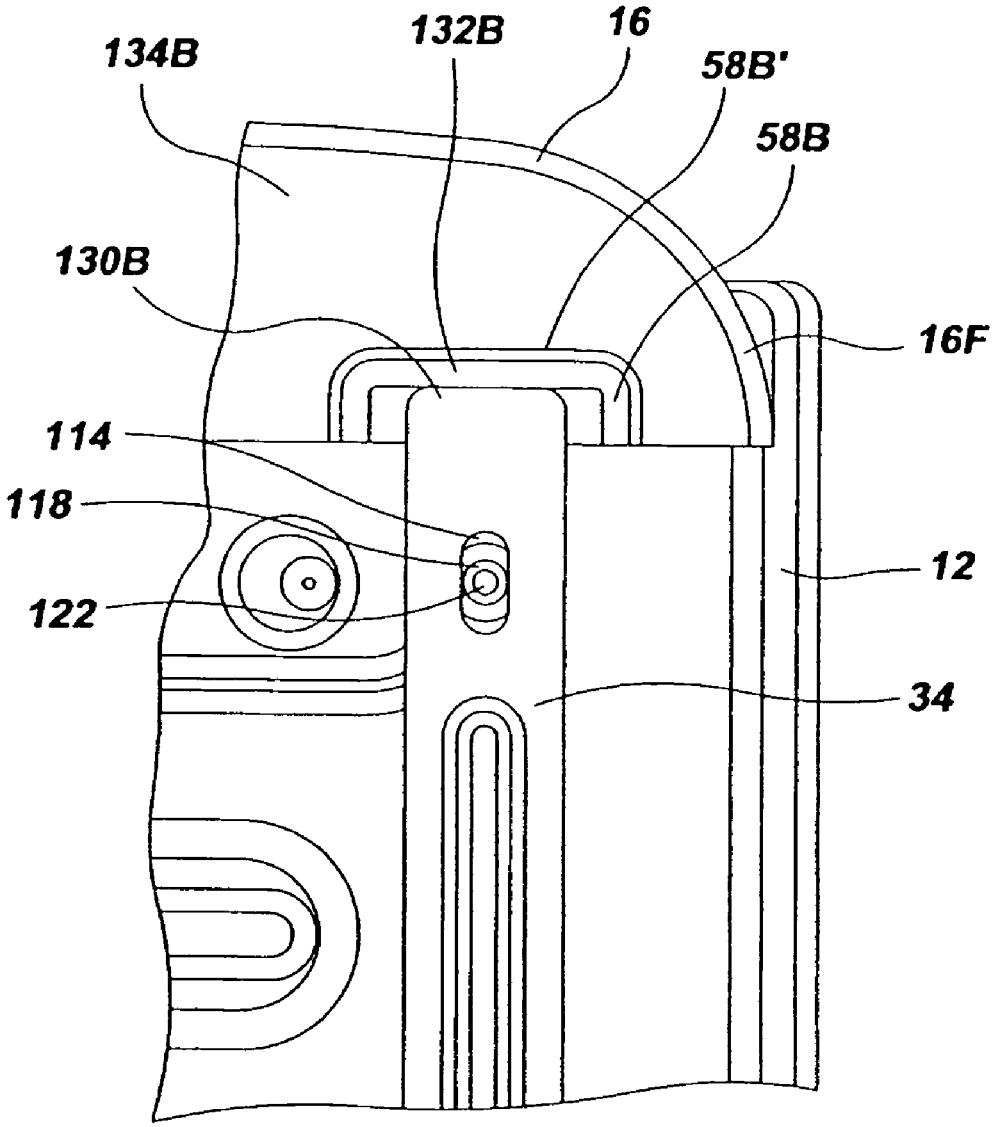
FIG. 8B is a bottom view of FIG. 8 showing the placement of the sill under the left sidewall.

FIG. 8B is a bottom view of FIG. 8A that shows the sill 34 extending into indent opening 58B of left sidewall 16. Note that the end 130B of sill 34 does not extend to the end wall 58B' of indent opening 58B. There is a space 132B which is sized to permit expansion and contraction of the sill without contacting end wall 58B'. The sill is shown connected to the foundation by fastener 122 in slot 114. The spacer 118 is shown surrounding the fastener 122.

The other slotted openings discussed above such as slots 68A, 68B and 68C of sidewall 18 shown in FIG. 4A are similarly configured to allow for expansion and contraction.

Figure 9:
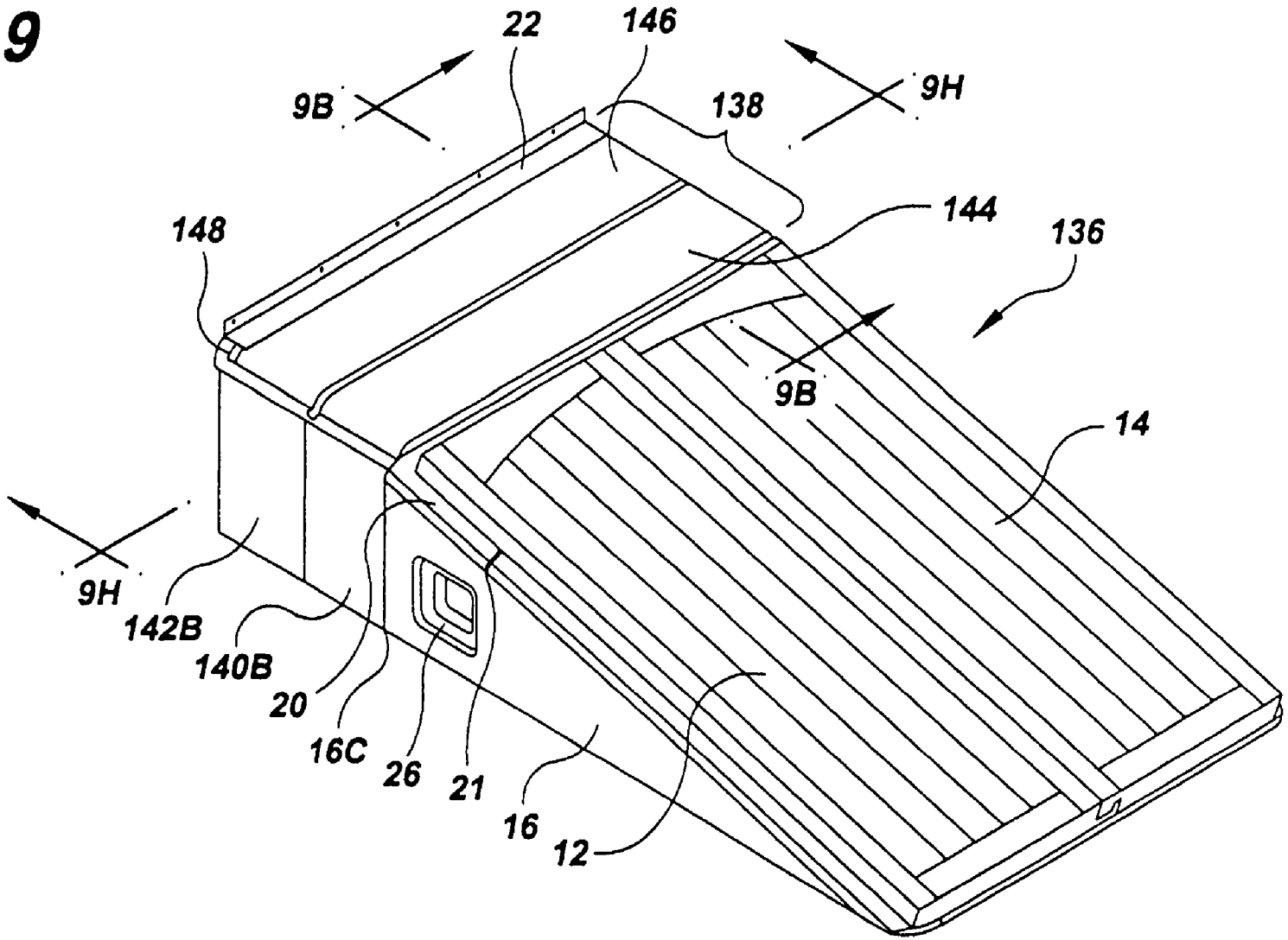
FIG. 9 is a perspective view of a door assembly of the invention with two extension headers extending the door assembly from the structure to which the door assembly would be attached.

FIG. 9 shows a perspective view of another door assembly of the invention 136 utilizing two extensions to position the door assembly away from the structure to which the door assembly is secured. The door assembly 136 comprises a right door leaf 14 and a left door leaf 12. The left door leaf 12 is positioned on sidewall 16 which has a window opening 26. Header 20 is positioned at the leg end 16C of the sidewall.

The extension is shown in composite as numeral 138 and comprises two upper horizontal extensions 144 and 146 mated together. The upper horizontal extensions have corresponding mating sidewalls 140B and 142B with the opposed sidewalls 140A and 142A (not shown). A spacer 148 is shown at the rear end of top horizontal extension 146 and structure flange 22 is shown as in the previous figures to further secure the door assembly to the structure.

Figure 9A:
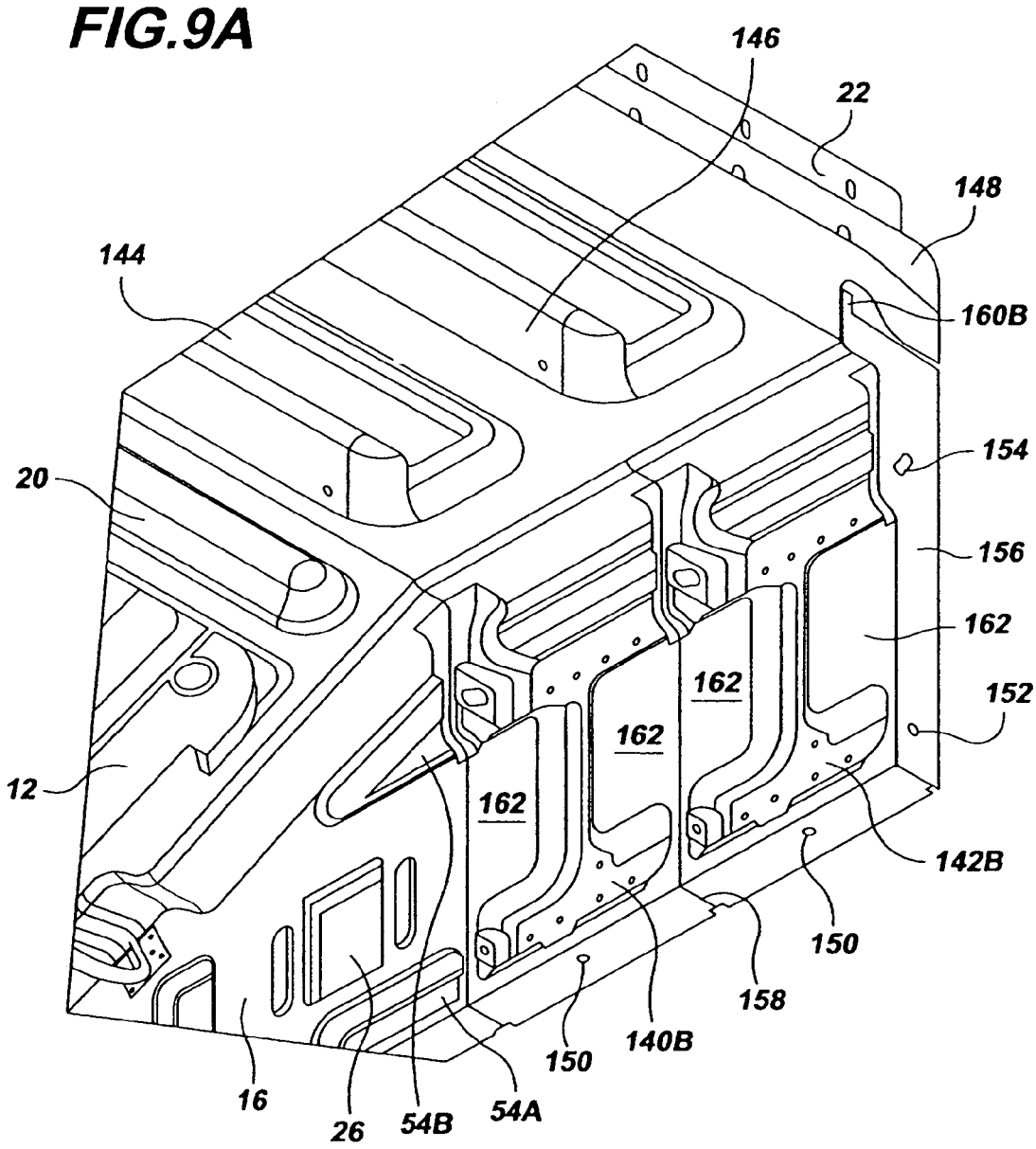
FIG. 9A is a partial bottom perspective view of the door assembly of FIG. 9.

FIG. 9A shows a bottom view of the door assembly of FIG. 9. Left sidewall 16 is shown connected to extension vertical sidewall 140B which sidewall is connected to extension vertical sidewall 142B providing a two component extension. Top horizontal extensions 144 and 146 are shown connected respectively to sidewalls 140B and 142B.

A spacer 148 is shown at the upper end of vertical sidewall 142B. The structure flange 22 is shown on top of spacer 148. Note that the vertical extension members 140B and 142B have a lower sidewall opening 152 for connecting the extenders together as well as connecting extender 140B to the sidewall 16 and to the structure. At the upper end of the vertical extension members is an angularly slotted opening 154 for likewise connecting the vertical extenders together as well as connecting the extender to the sidewall 16 and to the structure. At the base of the vertical extenders is an opening 150 for securing the vertical extenders to the foundation.

The vertical extenders 140B and 142B are shown having hollow protrusions 162 which provide support to the member. At the upper end of each vertical extender member is an edge 160B which runs the width of the member and which mates with the horizontal extenders 146 and 144 as will be described hereinbelow. The header 20 is shown abutted to horizontal extender 144. Door 12 is shown resting on sidewall 16 and header 20.

Figure 9B:
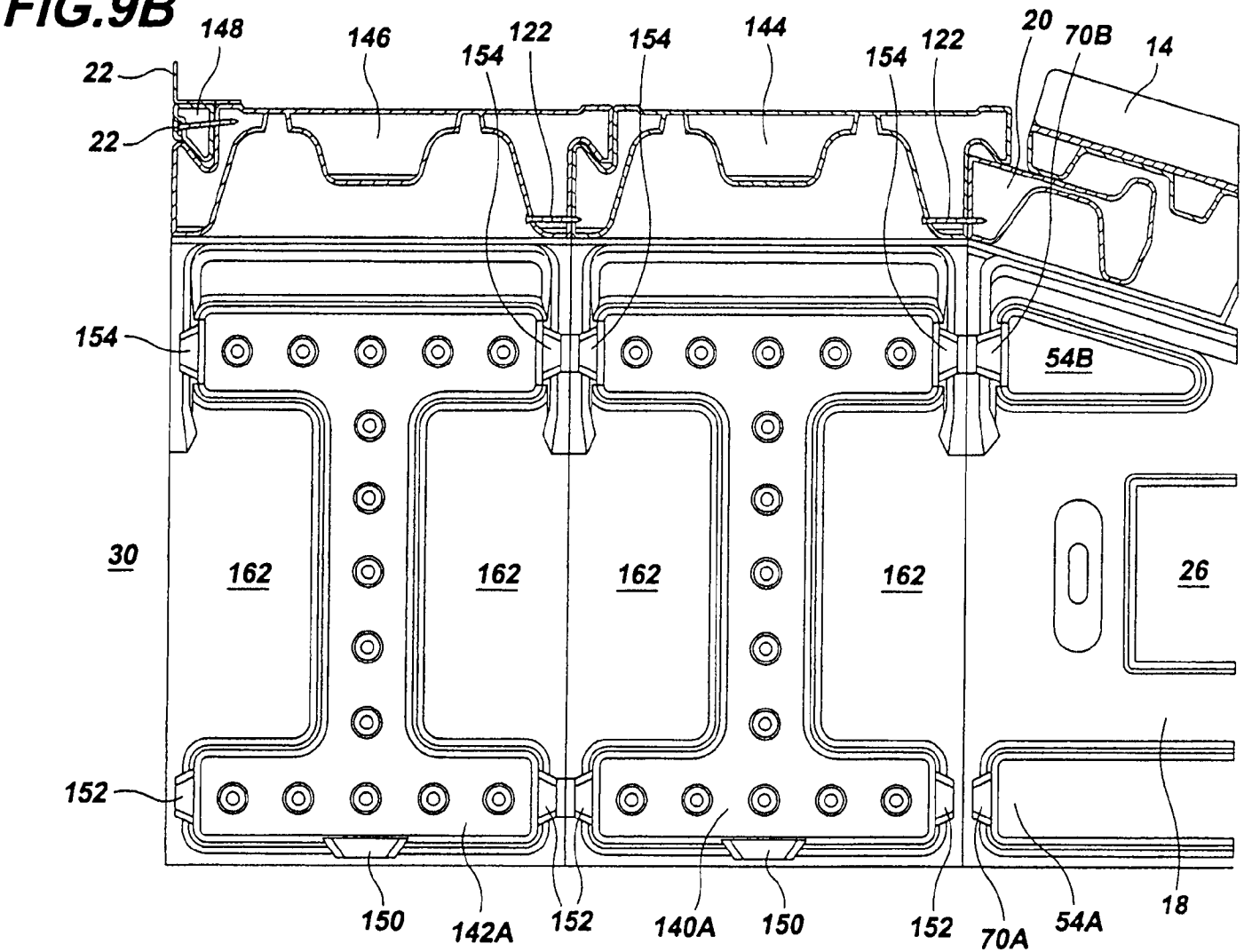
FIG. 9B is a cross-sectional view of FIG. 9 taken along line 9B-9B

FIG. 9B is a cross-sectional view of FIG. 9 and shows top horizontal extenders 144 and 146 positioned on vertical extenders 140A and 142A, respectively. Extender 140A would be connected to sidewall 18 with a fastener extending through openings 70A and 152 and a fastener extending between slotted openings 70B and 154. Extenders 140A and 142A are fastened together through openings 152 and 154. Extender 142A is fastened to structure 30 through openings 152 and 154.

Top horizontal extenders 144 and 146 are shown joined together by fastener 122. A fastener 122 is also shown connecting spacer 148 to horizontal extender 146. Extender 144 is fastened to header 20 by fastener 122.

Figure 9E:
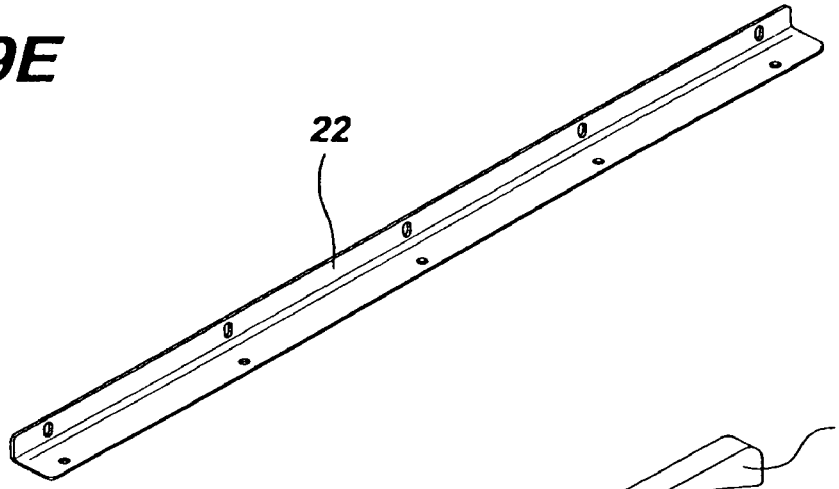
FIG. 9E is a perspective view of the flange used to connect the structure to be enclosed to the door assembly.
Figure 9D:
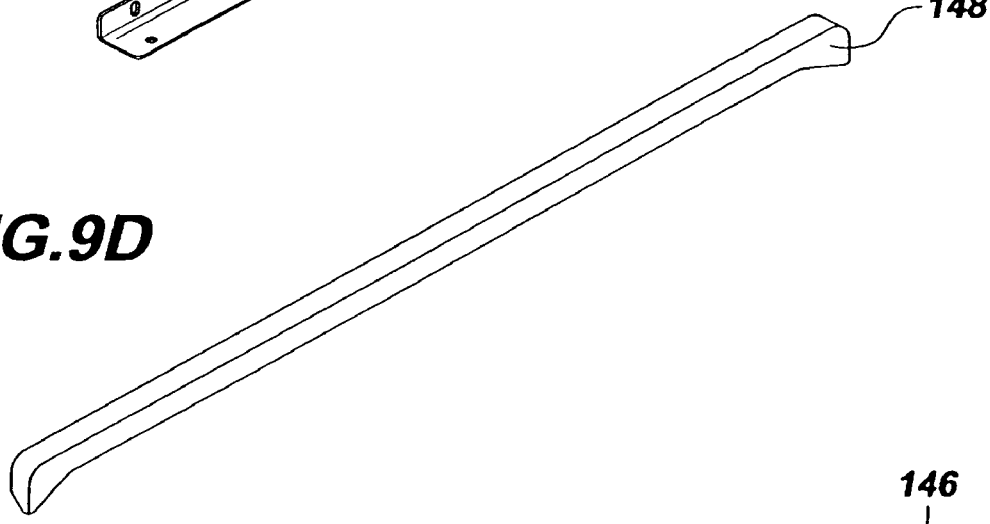
FIG. 9D is a perspective view of a spacer of the invention.
Figure 9C:
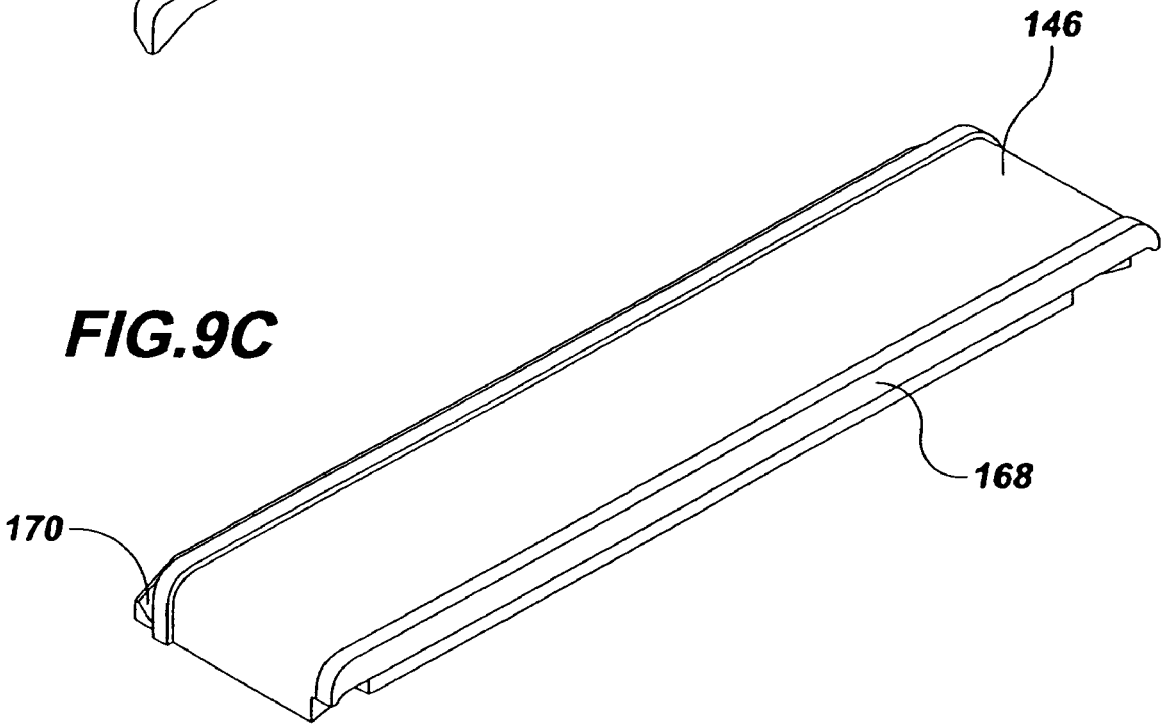
FIG. 9C is a perspective view of a horizontal extension header of the invention.

FIG. 9C is a perspective view of top horizontal extension member 146. Horizontal extension member 144 and other horizontal extension members are the same. The horizontal extender has a front overhanging inverted J-shaped edge 168 running along the length of the extender. At the back of the extender is a J-shape groove 170 also running along the length of the extender. The purpose of the overhang groove 168 and back groove 170 is for mating the extenders if more than one extender is used and/or to overhang the header of the door assembly to provide additional protection against water leakage into the door assembly. (See FIG. 9B.)

FIG. 9D is a spacer 148 of the invention which is used to mate with groove 170 of the extender 146 at the junction between the rear of the extender and the structure being enclosed.

FIG. 9E is an L-shaped structure flange to further hold the door assembly to the structure.

Figure 9F:
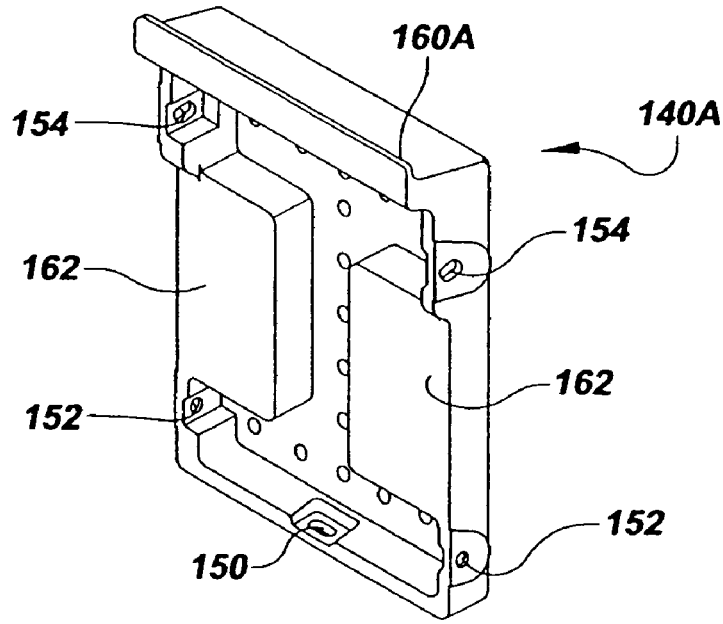
FIG. 9F is a perspective view of a right vertical extension member of the invention.

FIG. 9F is a perspective view of a right vertical extender of the invention shown as numeral 140A. The extender has protrusions 162 to provide strength and support to the extender and an upper lip 160A for mating with the horizontal extender and for securing the horizontal extender to the vertical extender with a fastener. The vertical extender is provided in each vertical sidewall with an angularly slotted opening 154 and circular opening 152 for connection to other extenders, the structure to be enclosed or to sidewalls of the door assembly. Lower opening 150 in the base of the vertical extender is provided for securing the member to the foundation and is preferably slotted.

Figure 9G:
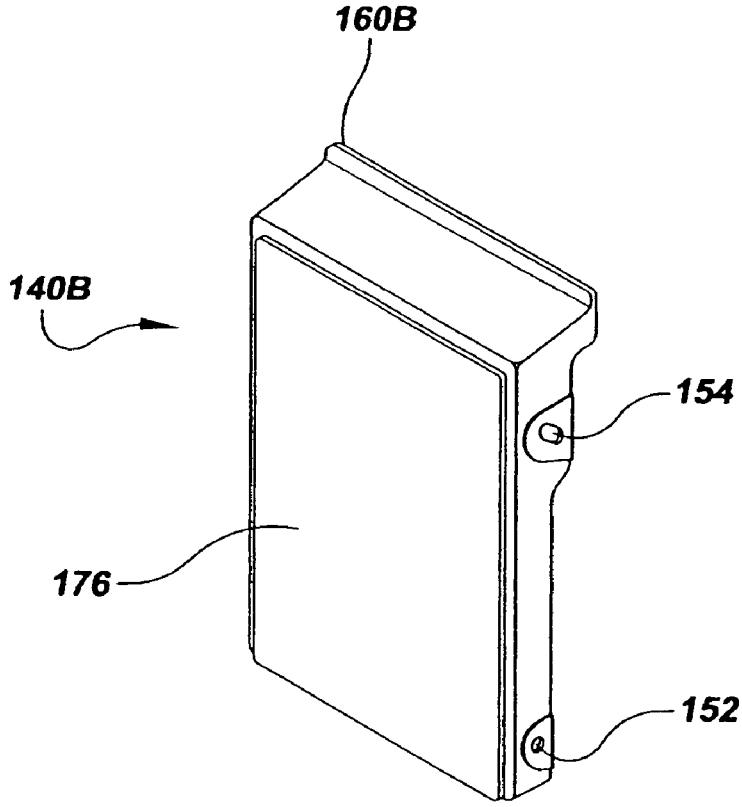
FIG. 9G is a perspective view of a left vertical extension.

FIG. 9G shows left vertical extender 140B. As can be seen the extender has a planar outer wall surface 176.

Figure 9H:
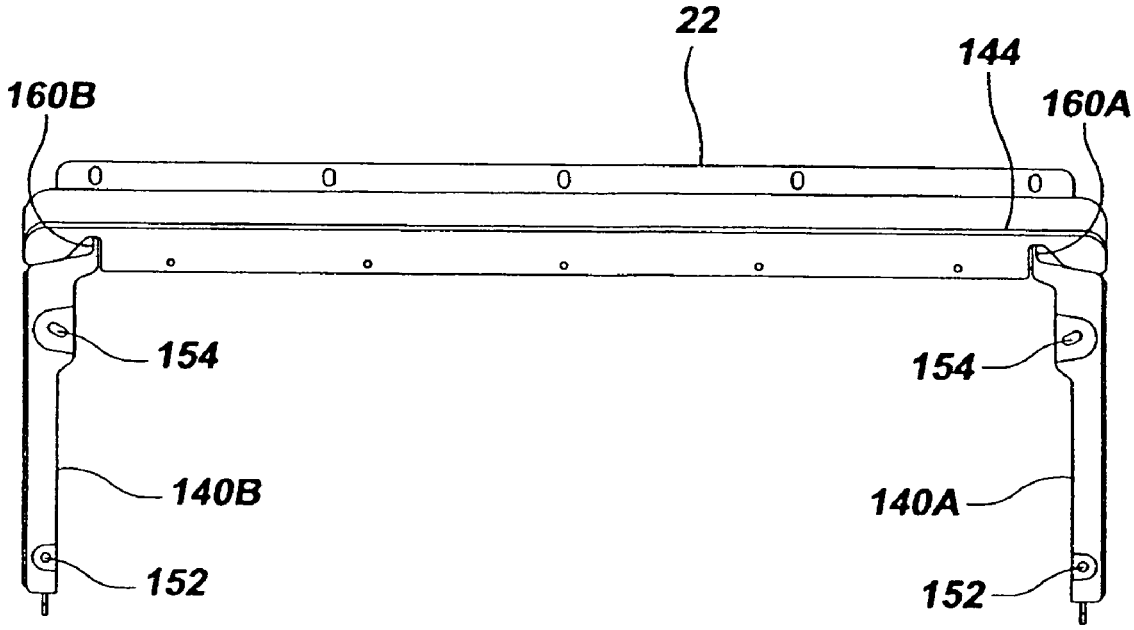
FIG. 9H is a cross-sectional view taken along line 9H-9H of FIG. 9.

FIG. 9H is a cross-sectional view of FIG. 9 showing the top horizontal extender 144 being supported by sidewall vertical extenders 140A and 140B. The top horizontal extender would be secured to the sidewall extenders by a fastener through the extender and lip 160A/160B.

Figure 9I:
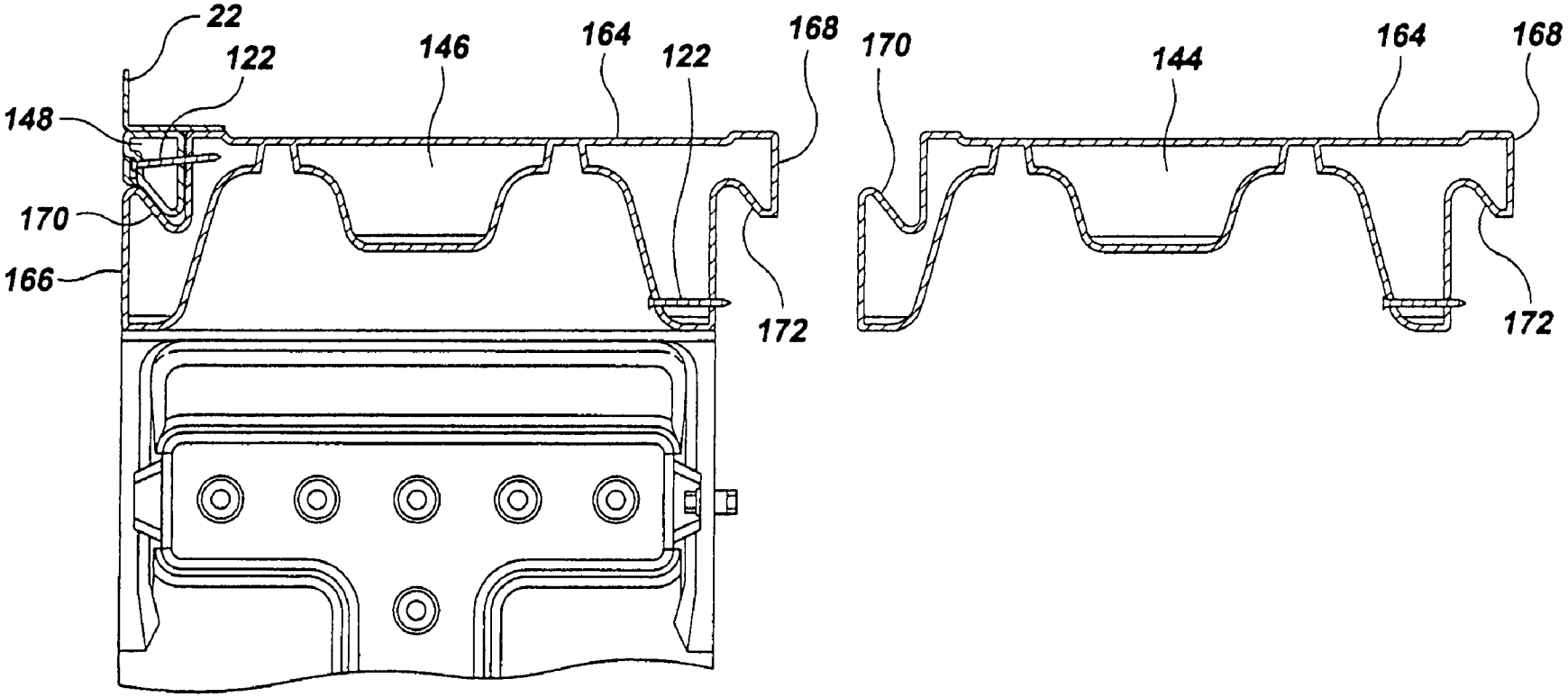
FIG. 9I is a partial exploded view of two horizontal extension headers of the invention to be mated.

FIG. 9I shows a partially exploded view of horizontal extender 146 to be connected to horizontal extender 144. The vertical extender is not shown for clarity. Note that horizontal extender 144 is the same as extender 146, and both have a front edge 168 having an inverted overhanging J-shape groove 172. The rear edge of the extender has a J-shape groove 170. The two extenders are connected by mating the J-shaped groove 170 of extender 144 with inverted J-shaped groove 172 of extender 146. Both extenders would be connected together by fastener 122. Spacer 148 is shown mated in J-shaped groove 170 and the spacer secured to extender 146 by fastener 122. Structure flange 22 is then secured to the spacer 148 and the structure (not shown).

Referring back to FIG. 9B, the mated J-shaped joints in the horizontal extenders provide excellent protection against water leakage since water leaking into the joint will flow by gravity to the outer walls of the extender and down the vertical sidewalls away from the opening being enclosed.

Referring now to FIG. 10A, a perspective view of a header plate 20 of the invention is shown. The header has a rear straight edge 178 which will be positioned typically against the structure being enclosed. The header has a front U-shaped opening having a left arm 182A and a right arm 182B. A raised lip 92 runs along the length of the U-Shape. The header also has an upper flat surface 186 and an upper curved left arm surface 184A and right arm surface 184B. When the header is positioned on the sidewalls as part of the door assembly, water falling on the upper surface 186 of the header will flow as shown by the arrows along the lip 92 and away from the opening. Also, when the header 20 is mated with the sidewalls, as shown for example in FIG. 1A at mated joints 21, water flowing into the mated joint 21 will likewise flow away from the opening because of raised edge 74A and 78A and 74B and 78B of the sidewalls as shown in FIGS. 4A and 4B. A return flange 56 may also be connected to edge 180 of the header as shown in FIG. 2 to further enhance water drainage away from the opening.

Figure 10B:
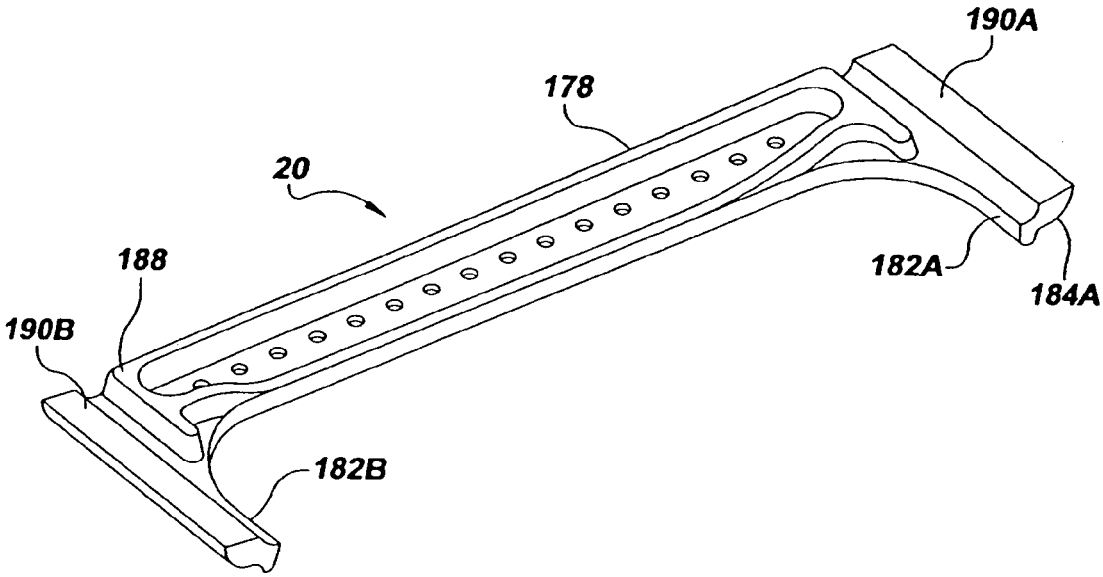
FIG. 10B is a bottom perspective view of the header plate of FIG. 10A.

FIG. 10B shows a perspective bottom view of the header of FIG. 10A. The header has a bottom surface 190A and 190B which will rest on respective sidewall surfaces 76A and 76B as shown in FIGS. 4A and 4B. The header has a raised support rib 188.

Any suitable polymer may be used to make the components of the door assembly. A preferred polymer is high density polyethylene (HDPE) because of its demonstrated effectiveness. Typically, the thickness of the component walls may vary widely depending on the strength desired and generally the thickness is about ⅛ inch to ¼ inch being used at anchor points.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A polymer composite basement door comprising:

a polymer composite frame positioned on a foundation surrounding an opening adjacent a building structure, the frame having opposed triangular sidewalls having a base, vertical leg, upper sloping surface with an inner edge, end, and inner and outer walls and a header plate connecting each sidewall, with the header plate and vertical leg adjacent the building structure; and one or more polymer composite door leafs hinged to the sidewalls for movement between an elevated open position providing access to the opening and a closed position covering the opening;

wherein the header plate has a straight rear edge for positioning against the structure and a U-shaped front edge having a left arm and a right arm, which ends of the left arm and right arm mate with the corresponding opposed triangular sidewalls and form a gap between the ends of each arm and the end of the upper sloping surface of the sidewalls wherein water entering the gap is diverted away from the opening by gravity and the inner edge of the sidewall.

2. The basement door of claim 1 wherein the front edge of the header plate has a raised lip for diverting water from the opening being enclosed.

3. A polymer composite basement door comprising:

a polymer composite frame positioned on a foundation surrounding an opening adjacent a building structure, the frame having opposed triangular sidewalls having a base, vertical leg, upper sloping surface, end and inner and outer walls and a header plate connecting each sidewall, with the header plate and vertical leg adjacent the building structure;

one or more polymer composite door leafs hinged to the sidewalls for movement between an elevated open position providing access to the opening and a closed position covering the opening; and one or more extenders comprising opposed vertical extension members and a mating horizontal member, which members extend the door away from the structure being enclosed.

4. The basement door of claim 3 wherein the vertical extension members have a base with one or more openings for securing the member to the foundation and vertical sidewalls with one or more openings for securing the member to a sidewall, another vertical member or to the structure being enclosed.

5. The basement door of claim 4 wherein the upper opening in the vertical sidewall is slotted at an angle to the vertical axis of the sidewall.

6. The basement door of claim 5 wherein the opening in the base of the vertical member is slotted.

7. A polymer composite basement door comprising:

a polymer composite frame positioned on a foundation surrounding an opening adjacent a building structure, the frame having opposed triangular sidewalls having a base, vertical leg, upper sloping surface, end and inner and outer walls and a header plate connecting each sidewall, with the header plate and vertical leg adjacent the building structure;

one or more polymer composite door leafs hinged to the sidewalls for movement between an elevated open position providing access to the opening and a closed position covering the opening;

one or more through openings in one or both of the sidewalls and/or door leafs or other door assembly;

one or more inserts in the through opening; and one or more accessible elongated slotted through openings in the sidewall base for fastening the base to the foundation and one or more accessible through openings in the sidewall leg for fastening the leg to the structure being enclosed or to an extender;

wherein the header plate has a straight rear edge for positioning against the structure and a U-shaped front edge with a left arm and right arm and a raised lip, which ends of the left arm and right arm mate with the corresponding opposed triangular sidewalls and form a gap between the ends of each arm and the end of the upper sloping surface of the sidewalls wherein water entering the gap is diverted away from the opening by gravity and the inner edge of the sidewall.

8. The basement door of claim 7 wherein the insert is a screen or window.

9. The basement door of claim 8 wherein the length of the slotted through openings in the sidewall base increase toward the end of the sidewall.

10. The basement door of claim 9 wherein the upper opening in the sidewall leg is slotted and angled to the vertical axis of the sidewall.

11. The basement door of claim 10 wherein the upper surface of the sidewall has an inner edge which diverts water from the opening where the end of the header plate arms mate with the upper surface of the sidewall.

12. The basement door of claim 11 further comprising one or more extenders for extending the door away from the structure being enclosed.

13. A polymer composite basement door comprising:

a polymer composite frame positioned on a foundation surrounding an opening adjacent a building structure, the frame having opposed triangular sidewalls having a base, vertical leg, upper sloping surface, end and inner and outer walls and a header plate connecting each sidewall, with the header plate and vertical leg adjacent the building structure;

one or more polymer composite door leafs hinged to the sidewalls for movement between an elevated open position providing access to the opening and a closed position covering the opening;

one or more through openings in one or both of the sidewalls;

one or more inserts in the through opening for a window and/or screerv and wherein the header plate has a straight rear edge for positioning against the structure and a U-shaped front edge having a left arm and a right arm, which ends of the left arm and right arm mate with the corresponding opposed triangular sidewalls and form a gap between the ends of each arm and the end of the upper sloping surface of the sidewalls wherein water entering the gap is diverted away from the opening by gravity and the inner edge of the sidewall.

14. The basement door of claim 13 wherein the insert is a window.

15. The basement door of claim 13 wherein the insert is a screen.

16. The basement door of claim 13 wherein the inserts may be changed without the use of tools.

17. A polymer composite basement door comprising:

a polymer composite frame positioned on a foundation surrounding an opening adjacent a building structure, the frame having opposed triangular sidewalls having a base, vertical leg, upper sloping surface, end and inner and outer walls and a header plate connecting each sidewall, with the header plate and vertical leg adjacent the building structure;

one or more polymer composite door leafs hinged to the sidewalls for movement between an elevated open position providing access to the opening and a closed position covering the opening;

one or more accessible elongated longitudinal slotted through openings in the base for fastening the base to the foundation and one or more accessible through openings in the leg for fastening the leg to the structure or to an extender wherein the length of the slotted through openings increase toward the end of the sidewall; and wherein the header plate has a straight rear edge for positioning against the structure and a U-shaped front edge having a left arm and a right arm, which ends of the left arm and right arm mate with the corresponding opposed triangular sidewalls and form a gap between the ends of each arm and the end of the upper sloping surface of the sidewalls wherein water entering the gap is diverted away from the opening by gravity and the inner edge of the sidewall.

18. The basement door of claim 17 wherein there are at least two accessible through openings in the leg with the upper opening being slotted and angled to the vertical axis of the sidewall.

19. The basement door of claim 18 further comprising a sill positioned transverse to the opposed sidewalls at the end of the sidewalls and having a plurality of elongated longitudinal slots through openings for fastening the sill to the foundation.

* * * * *